US005774955A

United States Patent [19]

Borchardt et al.

[11] Patent Number: 5,774,955

[45] Date of Patent: Jul. 7, 1998

[54] CLOSURE DEVICE PROVIDING TACTILE CONFIRMATION OF OCCLUSION

[75] Inventors: Michael G. Borchardt, Naperville; John W. Williams, Oak Lawn, both of Ill.

[73] Assignee: First Brands Corporation

[21] Appl. No.: 673,653

[22] Filed: Jun. 28, 1996

[51] Int. Cl.[6] ..... B65D 33/00; B65D 77/00

[52] U.S. Cl. ..... 24/587; 24/30.5 P; 24/576; 383/63

[58] Field of Search ..... 24/30.5 R, 30.5 P, 24/587, 576, 400; 383/63, 35, 65

[56] References Cited

U.S. PATENT DOCUMENTS

| | | | |
|---|---|---|---|
| 3,679,511 | 7/1972 | Ausnit | 383/63 |
| 4,787,880 | 11/1988 | Ausnit | 383/63 |
| 4,907,321 | 3/1990 | Williams | 24/587 |
| 5,138,750 | 8/1992 | Gundlach et al. | 383/63 |
| 5,248,201 | 9/1993 | Kettner et al. | 24/587 |
| 5,403,094 | 4/1995 | Tomic | 24/587 |
| 5,558,439 | 9/1996 | Tilman | 24/587 |
| 5,577,305 | 11/1996 | Johnson | 24/576 |

FOREIGN PATENT DOCUMENTS

| | | | |
|---|---|---|---|
| 0477940 | 12/1953 | Italy | 24/576 |
| 2030634 | 4/1980 | United Kingdom | 24/30.5 R |

*Primary Examiner*—Victor N. Sakran
*Attorney, Agent, or Firm*—Gary L. Wamer

[57] ABSTRACT

A closure device providing tactile confirmation of occlusion is disclosed. The closure device comprises first and second interlocking fastening strips arranged to be interlocked over a predetermined length, at least one of the fastening strips having a deformation in the closure device after occlusion of the closure device. This deformation allows a user to tactually confirm that the closure device has been occluded, even after the closure device has been occluded. The deformation may be an inward deformation or an outward deformation on the fastening strip. The deformation may be on one or both of the fastening strips. The fastening strip may include multiple deformations. The deformation may be facilitated by providing a flexure point in the fastening strip, such as, an area of reduced cross-section or a coextruded portion with a different modulus of elasticity. In one embodiment of the invention, the fastening strips include mateable male and female closure elements. The male fastening strip includes a pair of first wings spaced apart on the fastening strip on the male closure element, whereas the female fastening strip includes a pair of second wings spaced apart on the female fastening strip to interfere with the first wings. When the male and female fastening strips are brought together to interlock, the first wings engage with the second wings such that at least a portion of the male fastening strip deflects to form an inward deformation.

79 Claims, 27 Drawing Sheets

CLOSURE DEVICE PROVIDING TACTILE CONFIRMATION OF OCCLUSION

RELATED APPLICATIONS

This application is related to copending application filed Jun. 28, 1996, entitled "VENTABLE INTERLOCKING CLOSURE STRIP", listing the inventors as Michael G. Borchardt and Ewald A. Kamp (deceased), Internal Reference No. D 15711 which is incorporated herein by reference. This application is related to copending application filed Jun. 28, 1996, entitled "FASTENING STRIPS WITH BARBED CLOSURE ELEMENTS", listing the inventor as Michael G. Borchardt, Internal Reference No. D 15713 which is incorporated by reference. This application has been assigned Internal Reference No. D 15712.

FIELD OF THE INVENTION

The present invention pertains to an interlocking closure device, and, more particularly, to a closure device providing tactile confirmation of occlusion. The closure device of the present invention may be employed in traditional fastener areas, and is particularly suited for use as a fastener for storage containers, such as plastic bags.

BACKGROUND OF THE INVENTION

The use of fastening devices for the closure of containers, including plastic bag bodies, is generally known. Furthermore, the manufacture of fastening devices made of plastic materials is generally known to those skilled in the art relating to closure devices, as demonstrated by the numerous patents in this area.

A particularly well-known use for fastening devices is in connection with flexible containers, such as bag bodies. The closure device and the associated container may be formed from thermoplastic materials, and the closure device and sidewalls of the container can be integrally formed by extrusion as a single piece. Alternatively, the closure device and sidewalls may be formed as separate pieces and then connected by heat sealing or any other suitable connecting process. The closure devices when incorporated as fasteners on bag bodies have been particularly useful in providing a closure means for retaining the contents within the bag body.

Conventional closure devices utilize mating male and female closure elements which are occluded. When conventional closure devices are employed, it often is difficult to determine when the male and female closure elements are occluded. This problem is particularly acute when the closure devices are relatively narrow. Accordingly, when conventional closure devices are employed, there exists a reasonable likelihood that the closure device is at least partially open.

The occlusion problem arises from the inability of a user to perceive when the male and female closure are occluded to form a seal between the contents of the bag and the environment external to the bag. A number of solutions to this problem have been attempted. For example, U.S. Pat. Nos. 4,186,786, 4,285,105, and 4,829,641, as well as in Japanese patent application No. 51-27719, disclose fasteners that provide a visual indication that the male and female closure elements are properly occluded. Specifically, a color change means for verifying the occlusion of the male and female members of the closure is provided wherein male and female members having different colors are employed, and, upon occlusion, provide yet a different color. For example, the female member of the closure may be opaque yellow and the male member of the closure may be translucent blue. Upon occlusion of the male member and female member a composite color with a green hue results. This use of a color change greatly improves the ability of the user of the interlocking closure device to determine when the male and female members are occluded.

The change in color that is viewed when dissimilarly colored male and female members are occluded is demonstrated in a commercially available product sold under the trademark GLAD-LOCK (Glad-Lock is the registered trademark of First Brands Properties, Inc., Danbury, Conn.). This color change effect may be enhanced by the incorporation of a color change enhancement member in the closure device, as disclosed in U.S. Pat. No. 4,829,641.

Color-changing closure devices are not a universal solution to the aforementioned problem of assuring full closure, however. For example, the color-change effect is imperceptible in the dark, thus mooting the color-change advantage of the closure devices when they are used under such conditions. In addition, sight-impaired or color-blind people may not be able to perceive the color-change effect. Accordingly, it would be desirable to provide a closure device that affords other indications of occlusion.

The prior art has attempted to furnish a fastener that provides a tactile or audible indication of occlusion. For example, U.S. Pat. Nos. 4,736,496, 5,138,750, 5,140,727, 5,403,094, and 5,405,478, as well as EP 510,797, disclose closure devices that allegedly provide a tactually or audibly perceptive indication of proper interlocking of the closure elements. It is said that, upon occlusion of the disclosed closure devices, a user is able to feel or hear that full closure is accomplished. For example, U.S. Pat. No. 4,736,946 discloses the use of additional ribs on either side of the closure elements. These ribs are said to give an improved "feel" to the closure, thus aiding a user in aligning the closure elements.

The devices shown in these references are able only to provide a dynamic tactile indication of occlusion, that is, the user is able to tactually perceive that the closure device is functioning properly only at the time the user is manually closing the device. Such devices do not provide a static tactile indication of occlusion, that is, they do not "feel" closed after occlusion has been effected. Accordingly, if a plastic bag containing such a closure device is sealed by one person, a second person will not readily be able to tactually determine that the bag is sealed. The ability to make such a determination is desirable. However, the prior art does not afford a closure device that enables such ability.

Thus, the prior art has failed to afford a closure device that provides a static tactile indication of occlusion. It is a general object of the present invention to provide such a closure device. It is a further general object of the present invention to provide a container that is closeable and sealable by means of such a closure device.

BRIEF SUMMARY OF THE INVENTION

The present invention satisfies these general objects by providing a closure device in which a user is able to tactually determine that the closure device has been occluded. The closure device comprises first and second interlocking fastening strips arranged to be interlocked over a predetermined length, at least one of the fastening strips having a deformation upon occlusion of the closure device. This deformation provides tactile confirmation of occlusion of the closure device. Thus, a user will be able to tactually confirm that the closure device has been properly occluded, not only while the user is in the process of occluding the closure device, but also after the closure device has been occluded.

DESCRIPTION OF THE EMBODIMENTS

The present invention provides interlocking closure devices in which a deformation is formed upon proper occlusion. A user thus is able to tactually perceive whether the closure device is properly occluded. In one embodiment, the closure device comprises interlocking male and female fastening strips arranged to be interlocked over a predetermined length. The male fastening strip includes a male closure element and a pair of male wings integrally attached to the male fastening strip and extending therefrom. The male wings are spaced-apart on the male fastening strip on each side of the male closure element and extending a greater distance from the base of the male fastening strip than the male closure element. The complementary female fastening strip includes a female closure element and a pair of female wings integrally attached to the female fastening strip and extending therefrom. The female wings are spaced-apart on the female fastening strip on each side of the female closure element to engage the male wings.

As used herein and as generally understood in the art, the terms "male" and "female" closure elements refer to closure elements wherein the element that interlocks into the other closure element and having outwardly projecting hooks is referred to as the "male closure element" and the outer element is referred to as the "female closure element" and has inwardly projecting hooks.

In accordance with this embodiment of the present invention, the female wings engage the male wings such that a portion of the male fastening strip flexes when the male and female fastening strips interlock. This flexure creates a deformation in the male fastening strip and the deformation is locked into place by the interlocking male and female closure elements. The deformation provides tactile confirmation of occlusion of the closure device.

Figure 1:
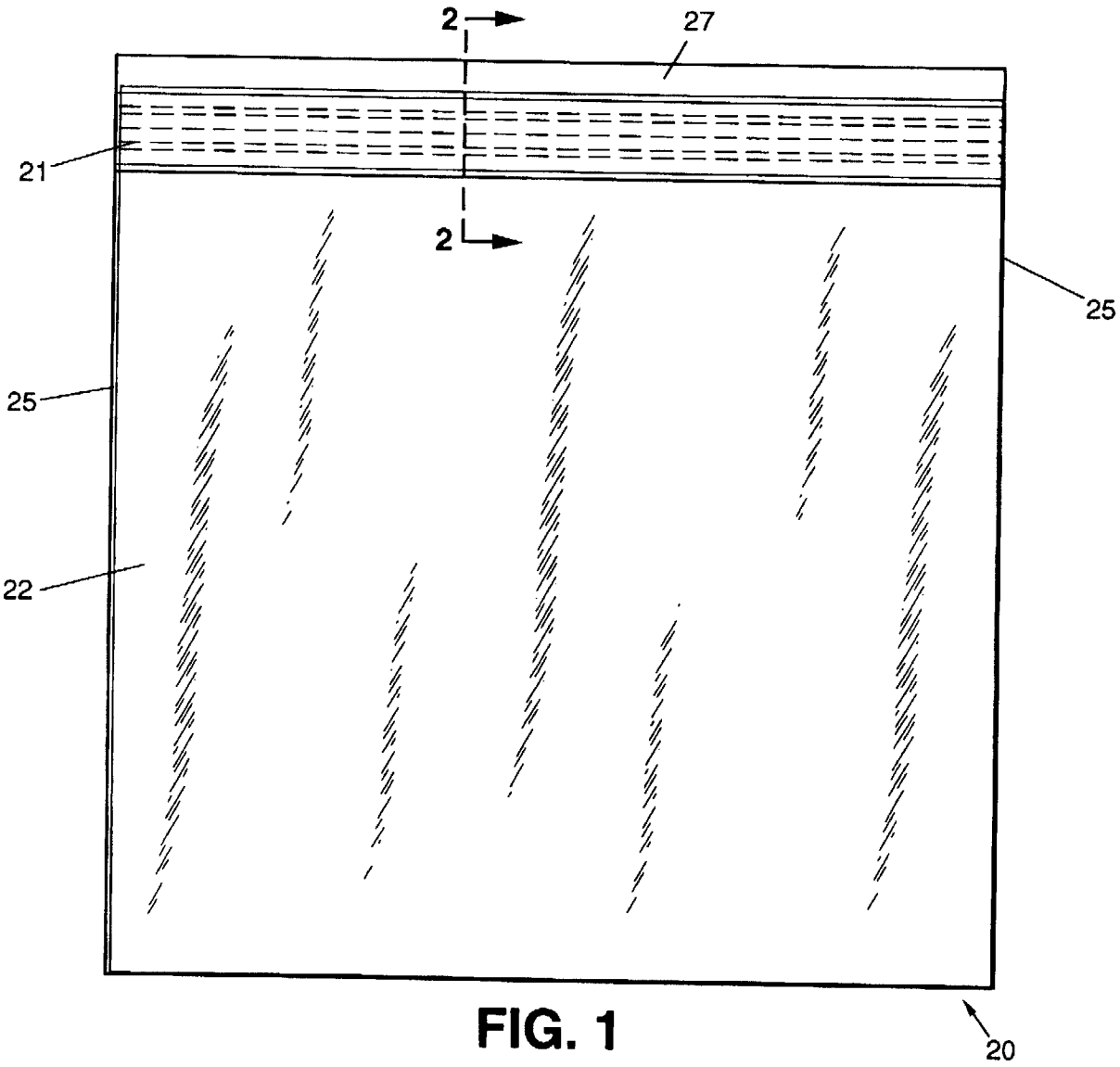
FIG. 1 is a perspective view of a container according to the present invention in the form of a plastic bag.

FIG. 1 illustrates a container according to the present invention in the form of a plastic bag 20 having a sealable closure device 21. The bag 20 includes side walls 22 joined at seams 25 to form a compartment sealable by means of the closure device 21. The side walls 22 extend above the closure device 21 to form mouth portions 27. Mouth portions 27 enable a user to grip the plastic bag 20 in a fashion to more conveniently be able to deocclude or open the closure device 21 to thereby open the bag 20.

Figure 2:
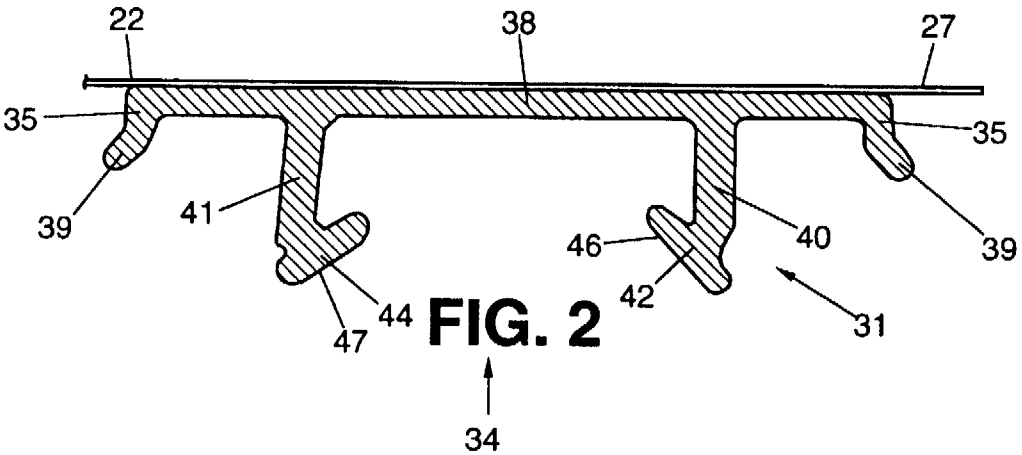
FIG. 2 is an enlarged partial cross-sectional view taken along line 2—2 in FIG. 1 illustrating the female fastening strip of a closure device of the present invention.
Figure 3:
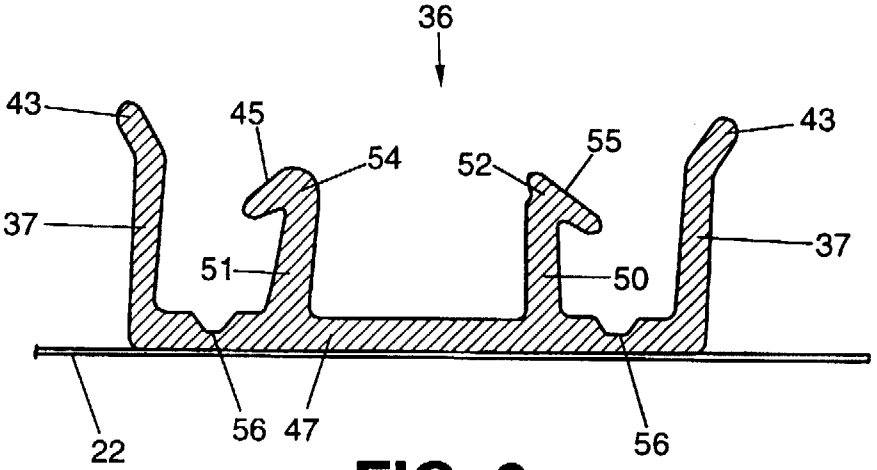
FIG. 3 is an enlarged partial cross-sectional view taken along line 2—2 in FIG. 1 illustrating the male fastening strip of a closure device of the present invention.

FIGS. 2 and 3 together illustrate a closure device according to one embodiment of the present invention. The closure device comprises male and female fastening strips 30, 31. As shown in FIG. 2, the female fastening strip 31 includes a female closure element 34 and a pair of female wings 35 spaced apart on the female fastening strip 31 on each side of the female closure element 34. As illustrated in FIG. 3, the male fastening strip 30 comprises a male closure element 36 for engaging the female closure element 34, and further comprises a pair of male wings 37 spaced-apart on the male fastening strip on each side of the male closure element 36.

The female closure element 34 comprises a base portion 38 having a pair of spaced-apart parallely disposed webs 40, 41 extending from the base portion 38. The webs 40, 41 include female hook portions 42, 44 extending from the webs 40, 41 respectively, and facing towards each other. The female hook portions 42, 44 include guide surfaces 46,47 which serve to guide the hook portions 42, 44 for occluding with the male hook portions of a mating closure element.

The male closure element 36 comprises a base portion 47 including a pair of spaced-apart, parallely disposed webs 50, 51 extending from the base portion 47. The webs 50, 51 include male hook portions 52, 54 extending from the webs 50, 51 respectively and facing away from each other. The male hook portions 52, 54 include guide surfaces 45, 55, which generally serve to guide the hook portions 52, 54 for occlusion with the female hook portions 42, 44 of the mating female closure element. The guide surface 45 may also have a rounded crown surface 45. In addition, the hooks may be designed so that the hooks 44, 54 adjacent the interior of the container provide a greater resistance to opening of the closure device. Notches 56 may be provided in the base portion 47 of the male closure element to facilitate deflection of the base.

The fastening strips further include wings as shown in FIGS. 2 and 3. The male wings 37 shown in FIG. 3 are flexible and extend further from the base of the fastening strip than does the male closure element 30. Each wing terminates in an end portion 43 which projects outwardly from the wing 37. Although two wings are shown, a greater or lesser number of wings may be used, such as, one, three, four or more wings. A pair of female wings 35 is included with the female fastening strip in order to engage the male wings 37. The female wings 35 extend from the female fastening strip 31 and terminate in end portions 39 which project outwardly from the wings 35. The number of female wings may be equal to, greater than, or less than the number of male wings.

Figure 4A:
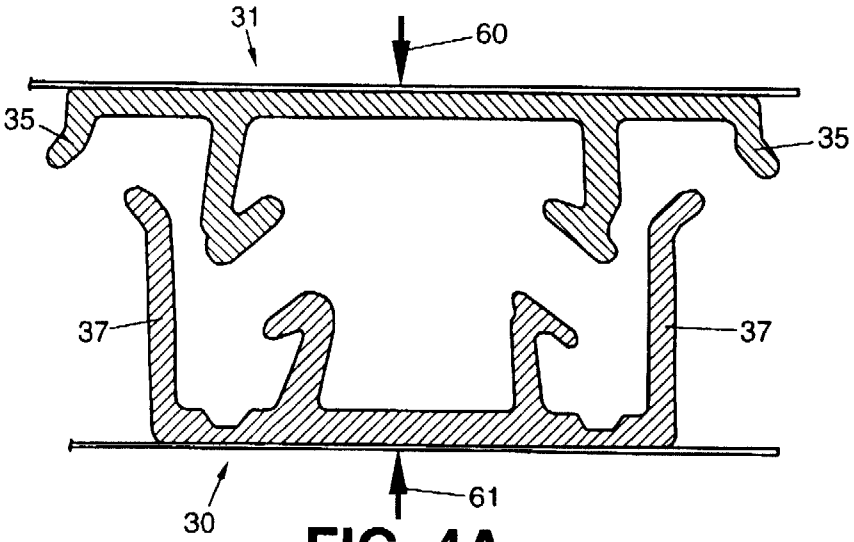
FIGS. 4A–4C are cross-sectional views of the male and female fastening strips illustrated in FIGS. 2 and 3 shown in various positions.
Figure 4B:
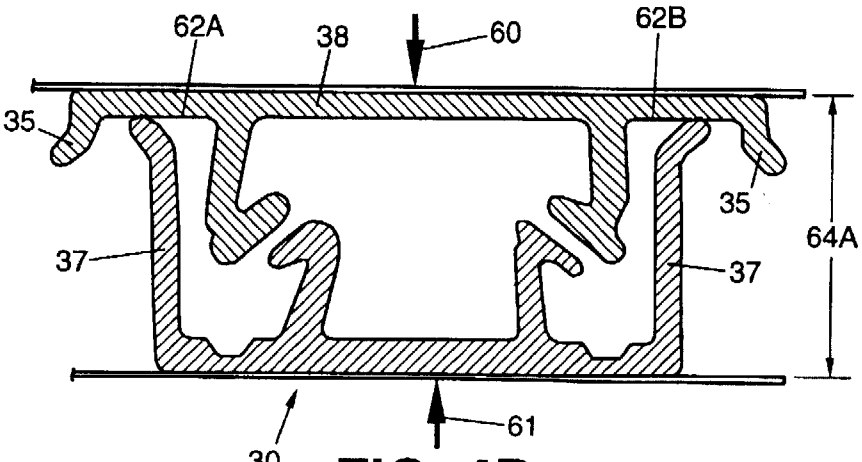
Figure 4C:
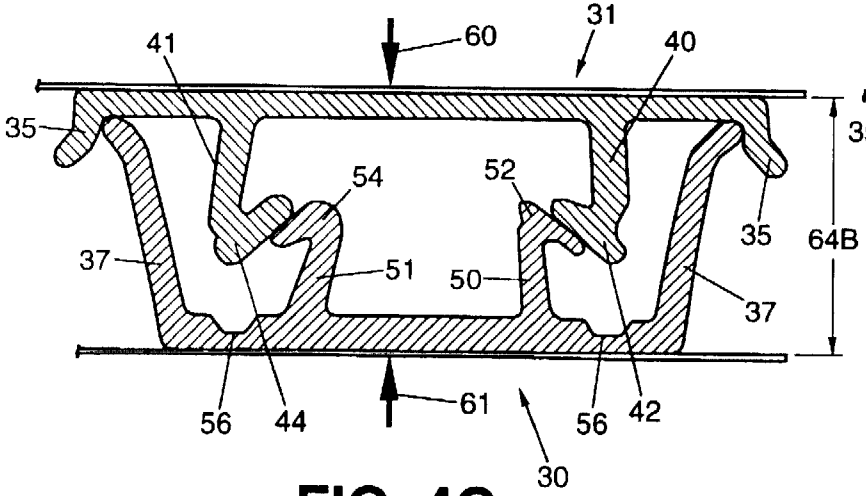

FIGS. 4A–4D illustrate occlusion of the closure device. In accordance with the invention, compression forces are applied to the opposed fastening strips 30, 31 in the direction denoted by the arrows 60, 61 shown in FIGS. 4A–4C. These forces are typically applied as the user depresses or pinches his or her fingers along a desired length of the fastening strips 30, 31. As the user begins to occlude the fastening strips, the male wings 37 engage the base portions 62A, 62B as shown in FIG. 4B. In this position, the fastening strips are separated by distance 64A. As the user continues to apply the forces 60, 61, the male wings 37 slide towards the female wings 35 until the female wings 35 contact the male wings 37 as shown in FIG. 4C. In this position the fastening strips are separated by distance 64B which is less than distance 64 due to the movement of the wings 37. Also, the female hooks 42, 44 have contacted the male hooks 52, 54 as shown in FIG. 4C.

Figure 4D:
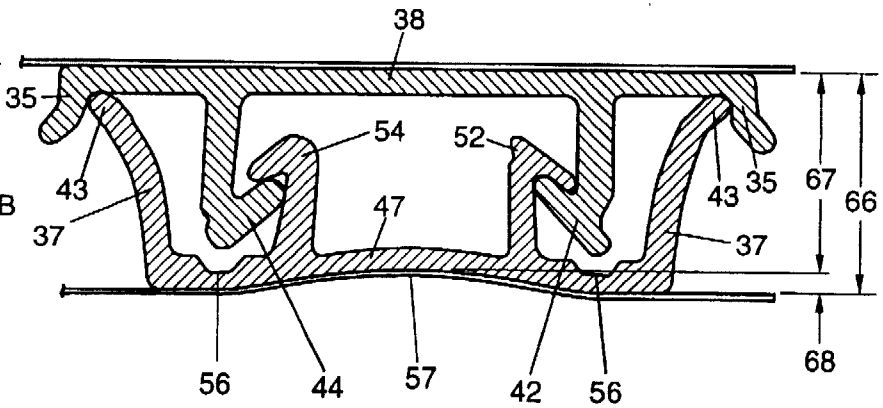
FIG. 4D is a cross-sectional view of the fastening strip of FIGS. 2–3 in the occluded position, and illustrating the inward deformation formed by flexure of the male fastening strip upon occlusion.

In order to hold the fastening strips in an occluded position, the female hooks 42, 44 must engage the male hooks 52, 54. As the user continues to apply the forces 60, 61, the female webs 40, 41 deflect outwardly and the male webs 50, 51 deflect inwardly in order to allow the female hooks 42, 44 and the male hooks 52, 54 to pass each other. In addition, the hooks may also deflect during this process. As the user continues to apply the forces 60, 61, the female hooks 42, 44 engage the male hooks 52, 54 as shown in FIG. 4D. During this process, the base of the male fastening strip deflects inward and forms an inward deformation 57. The deformation 57 is retained because the male wings 37 are more rigid than the base and because the male wings 37 are prevented from further outward movement by the wings 35. In addition, the force exerted by the deflected base is less than the force required to disengage the hooks. In order to facilitate the deflection of the base, the fastening strip may include notches 56.

The fastening strips are separated a distance 66 near the male wings 37 and a distance 67 near the center of the fastening strips. The difference between distance 66 and distance 67 is the depth 68 of the deformation 57.

The wings employed in this embodiment of the present invention have the additional advantage of serving as guide members. Guide members sometimes are incorporated into conventional closure devices to provide a further improved "feel" and further accuracy to such devices. Such guide members have been provided in the shape of triangles, rectangles or other suitable shapes and are generally provided by extrusion as integrally connected to one or both of the closure elements. In this embodiment of the present invention, the wings provide a funneling-type action as the fastening strips are brought together and the female closure element is brought into contact with the male closure element.

Figure 7:
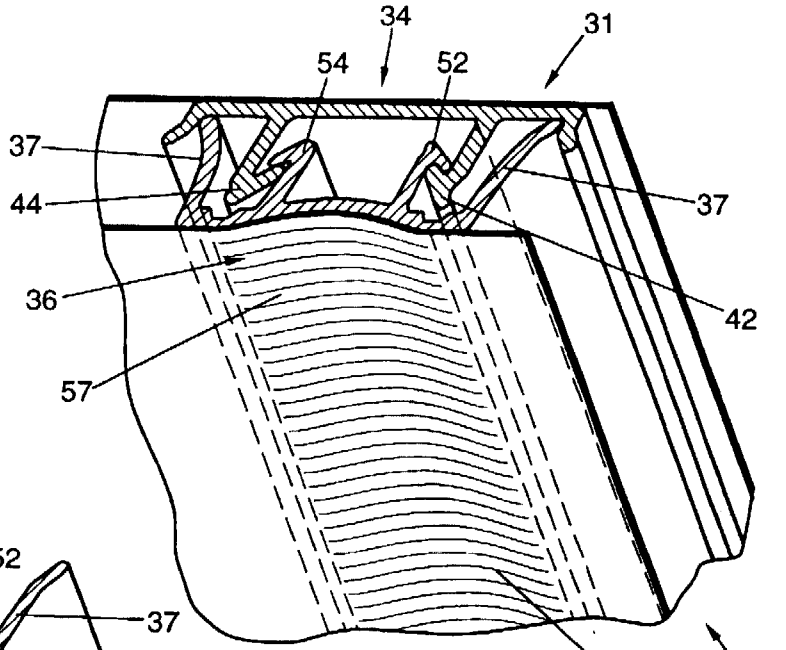
FIG. 7 is an enlarged perspective view of a closure device according to the present invention when occluded, illustrating the deformation formed upon occlusion of the closure device.
Figure 6:
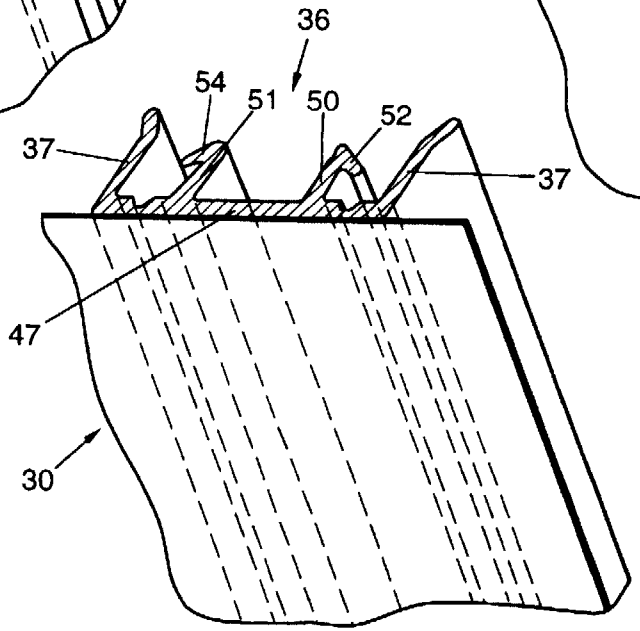
FIG. 6 is a perspective view of the male fastening strip illustrated in FIG. 3, including a male closure element and a pair of wings.
Figure 5:
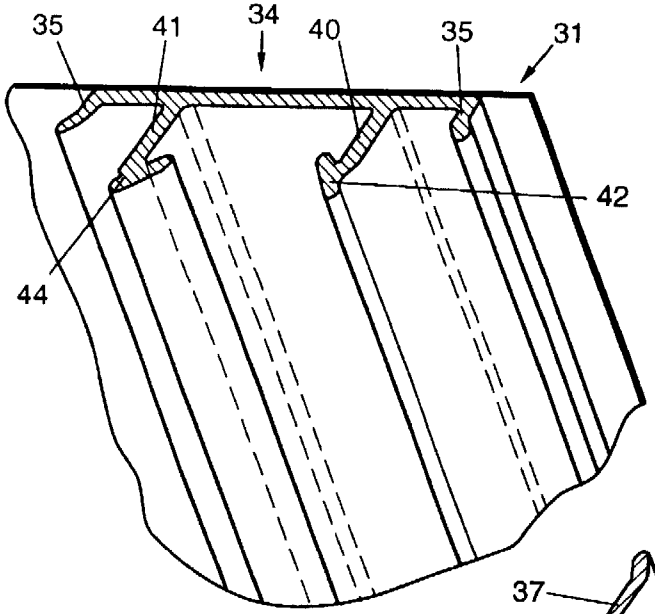
FIG. 5 is a perspective view of the female fastening strip illustrated in FIG. 2, including a female closure element and a pair of wings.

FIG. 7 illustrates the inward deformation 57 formed by the flexure of the male fastening strip. This deformation 57 provides a tactile confirmation of occlusion of the closure device. Accordingly, a user need only run his or her finger along the male fastening strip to confirm that the container is properly sealed.

Figure 10:
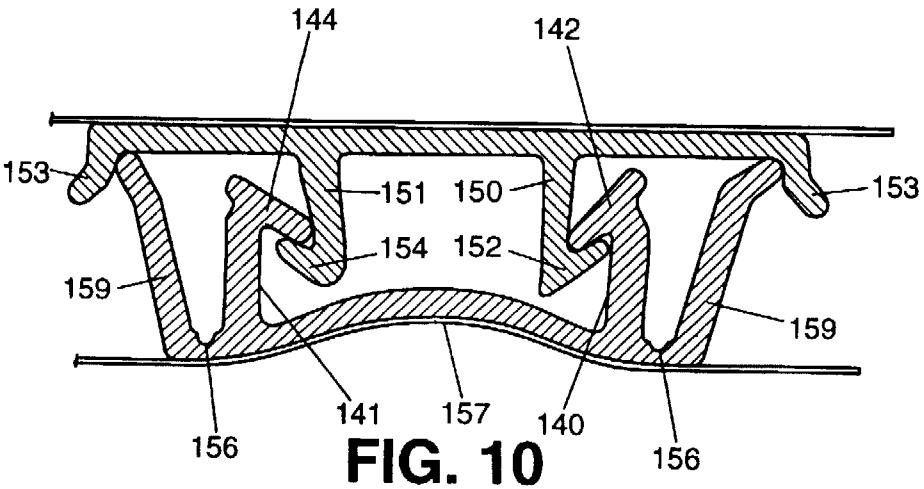
FIG. 10 is a cross-sectional view of the closure device formed by the male and female fastening strips illustrated in FIGS. 8 and 9 when occluded, illustrating in cross-section the deformation formed by flexure of the female closure element upon occlusion of the closure device.
Figure 8:
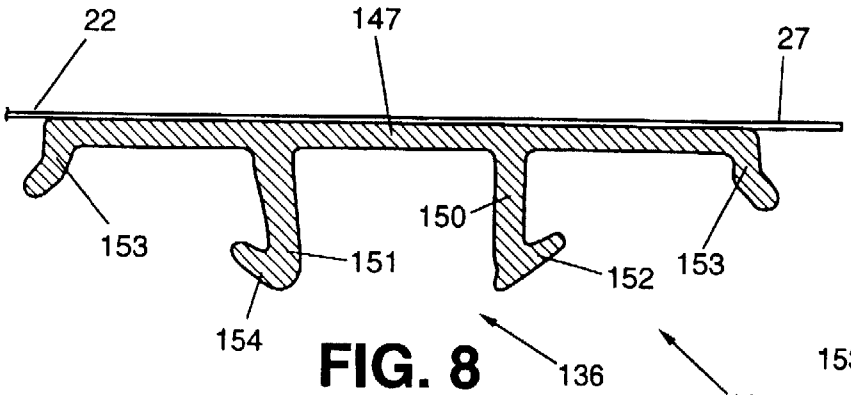
FIG. 8 is a cross-sectional view of the male fastening strip of another embodiment of the closure device according to the present invention, including a male closure element and a pair of wings on each side of the male closure element.
Figure 9:
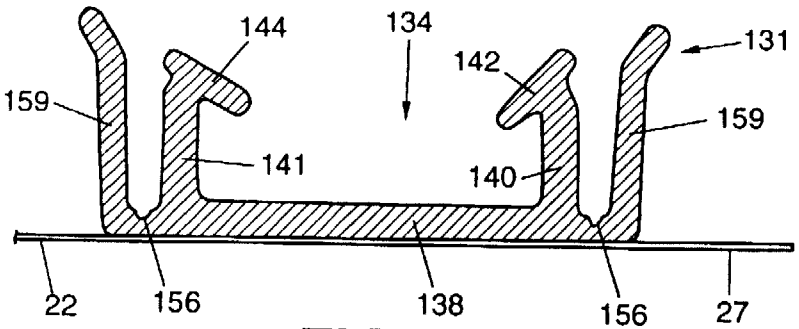
FIG. 9 is a cross-sectional view of the female fastening strip according to the present invention, complementary to the male fastening strip shown in FIG. 8, including a female closure element and a pair of wings on each side of the female closure element.
Figure 12:
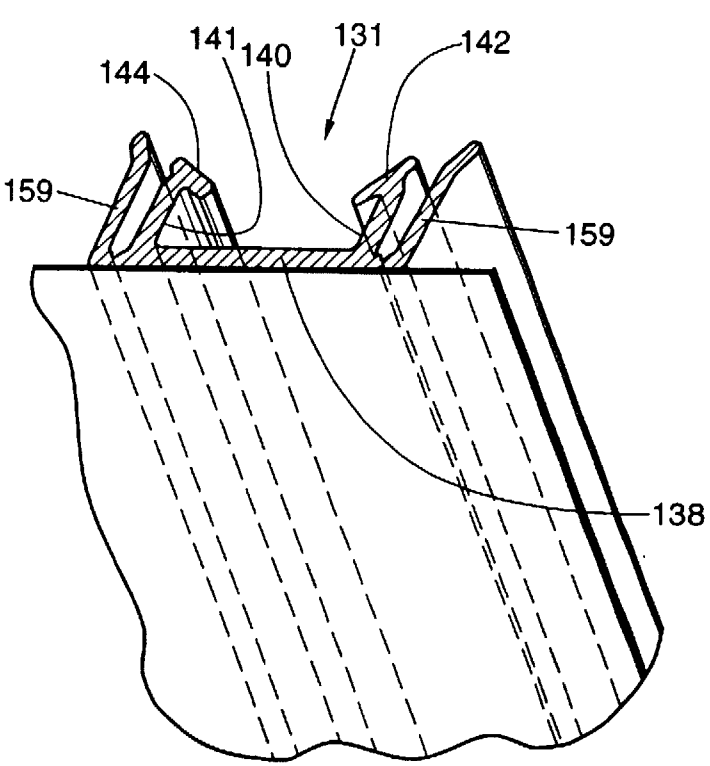
FIG. 12 is a perspective view of the female fastening strip illustrated in FIG. 9, having a female closure element and a pair of wings on each side of the female closure element.
Figure 11:
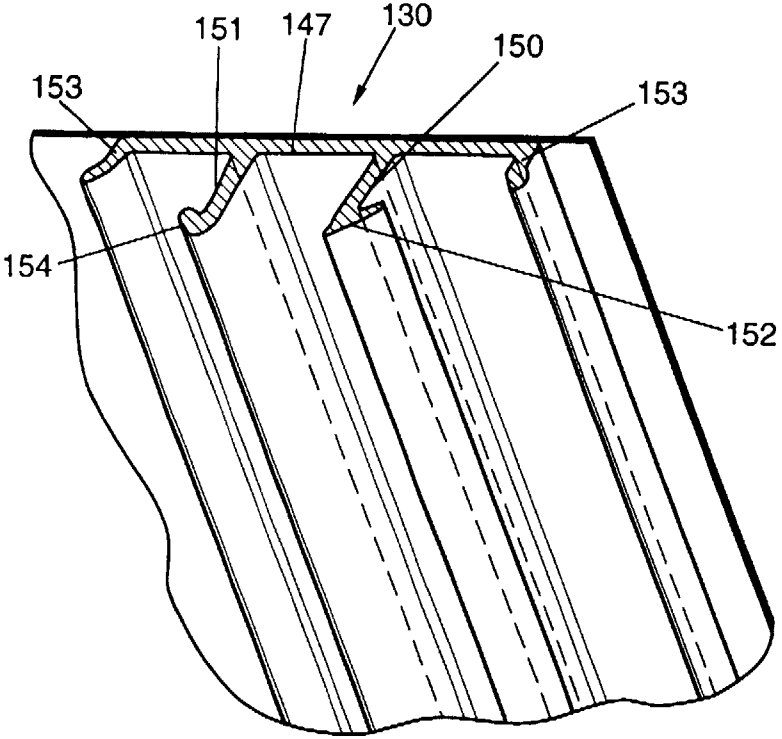
FIG. 11 is a perspective view of the male fastening strip illustrated in FIG. 8, having a male closure element and a pair of wings on each side of the male closure element.

In addition to a tactile confirmation of occlusion, other indications of occlusion may be provided. For example, the male and female fastening strips may include pigments so as to provide a visual indication of occlusion of the closure device. The conventional use of such pigments is known in the art and has been discussed above. For example, the male element may be translucent and the female element may be opaque. When the male and female element portions are occluded, a different color is provided for establishing visually the occlusion. The closure device may also include a color change closure as disclosed in U.S. Pat. No. 4,829,641. U.S. Pat. No. 4,829,641 is incorporated herein by reference. FIGS. 8 and 9 illustrate male and female fastening strips according to another embodiment of the present invention. As shown in FIG. 8, the male fastening strip 130 includes a pair of female wings 153, whereas, as shown in FIG. 9, the female fastening strip 131 includes a pair of male wings 159. The function of the closure device formed by the fastening strips shown in FIGS. 8 and 9 is analogous to that of the closure device illustrated in FIGS. 2–6, except that the female fastening strip 131 flexes to form an inward deformation 157 when the closure device is occluded rather than the male fastening strip 130. FIG. 10 illustrates the closure device formed by the fastening strip shown in FIGS. 8 and 9 in an occluded position. FIGS. 11 and 12 illustrate in further detail the fastening strips shown in FIGS. 8 and 9.

Specifically, female fastening strip 131 includes a female closure element 134 similar to female closure element 34 in FIG. 2. The female fastening strip 131 also includes a pair of male wings 159 similar to male wings 37 in FIG. 3 described above. The male fastening strip 130 includes a male closure element 136 similar to male closure element 36 in FIG. 3. The male fastening strip 130 also includes a pair of female wings 153 similar to female wings 35 in FIG. 2.

The female closure element 134 includes a base portion 138 similar to base portion 38 in FIG. 2 and includes webs 140, 141 similar to webs 40, 41 in FIG. 2. The webs 140, 141 include female hook portions 142, 144 similar to female hook portions 42, 44 in FIG. 2.

The male closure element 136 includes a base portion 147 similar to base portion 47 in FIG. 3 and includes webs 150, 151 similar to webs 50, 51 in FIG. 3. The webs 150, 151 include male hook portions 152, 154 similar to male hook portions 52, 54 in FIG. 3. Finally, the base portion 138 may be provided with notches 156 which are similar to notches 56 in FIG. 3.

Figure 13:
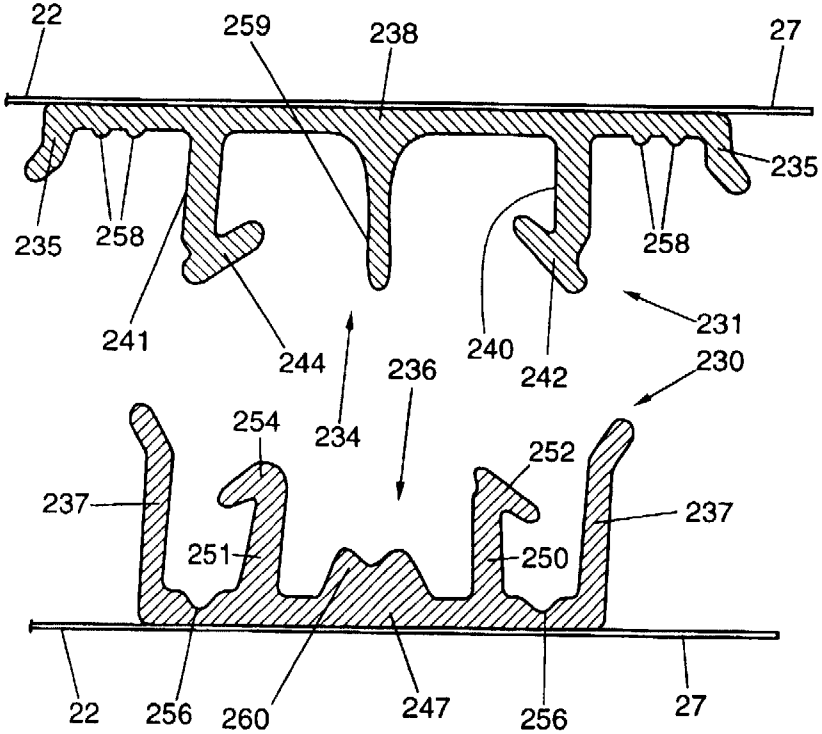
FIG. 13 is a cross-sectional view of a closure device according to the present invention wherein the female fastening strip includes a female closure element, a pair of wings on each side of the female closure element, a plurality of protrusions between each wing and the female closure element, and a spacer member.

FIG. 13 illustrates yet another embodiment of the closure device of the present invention. In this embodiment, the closure device includes a plurality of protrusions which engage wings to provide a dynamically tactile indication of proper occlusion.

Figure 14:
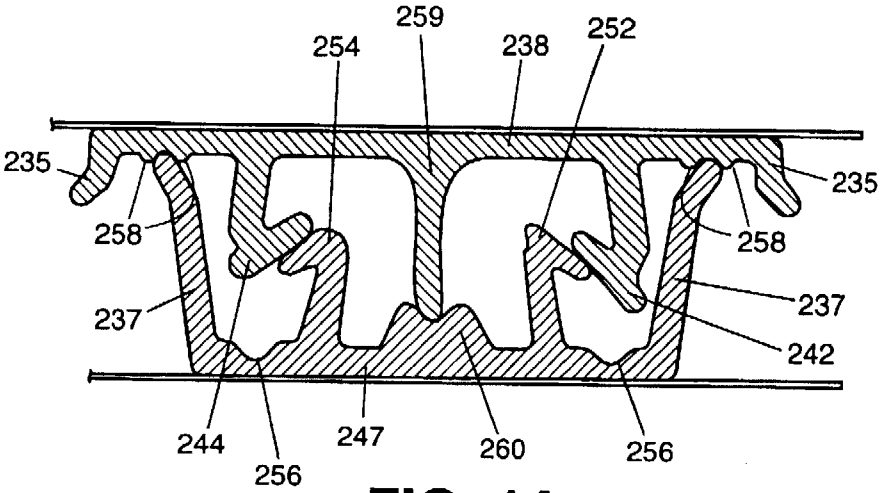
FIG. 14 is a cross-sectional view of the closure device illustrated in FIG. 13 as it is in the process of becoming occluded.
Figure 15:
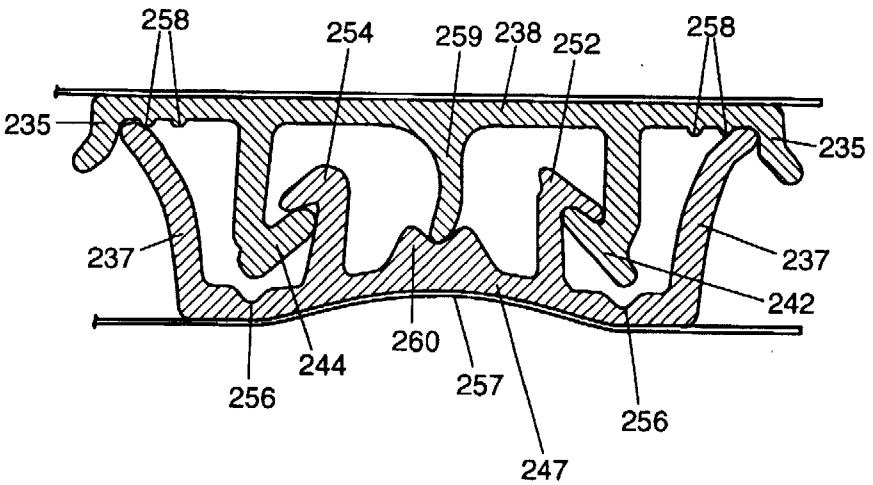
FIG. 15 is a cross-sectional view of the closure device illustrated in FIG. 13 when fully occluded.

Many of the components in FIGS. 13–15 are similar to FIGS. 2–6. Referring to FIG. 13, the closure device comprises male and female fastening strips 230, 231 similar to fastening strips 30, 31 in FIGS. 2 and 3. The female fastening strip 231 includes a female closure element 234 and a pair of wings 235 similar to female closure element 31 and wings 35 in FIG. 2. The male fastening strip 230 includes a male closure element 236 and a pair of wings 237 similar to male closure element 36 and wings 37 in FIG. 3. The female closure element 234 includes a base portion 238 and webs 240, 241 similar to base portion 38 and webs 40, 41 in FIG. 2. The webs 240, 241 include hook portions 242, 244 similar to hook portions 42, 44 in FIG. 2. The male closure element 236 includes a base portion 247 and webs 250, 251 similar to base portion 47 and webs 50, 51 in FIG. 3. The webs 250, 251 include hook portions 252, 254 similar to hook portions 52, 54 in FIG. 3. The base portion 247 may be provided with notches 256 which are similar to notches 56 in FIG. 3.

In this embodiment, the female fastening strip 231 includes a plurality of protrusions 258 spaced apart along the fastening strip on each side of the female closure element 234. These protrusions 258 are spaced apart to engage the wings 237 of the male closure element. The wings 237 travel in increments along the length of the female fastening strip 231 as the male and female fastening strips are brought together. This discrete travel is tactually perceptible to a user. Thus, in addition to providing a deformation 257 when the closure device is occluded, the closure device affords a dynamically tactile indication of proper occlusion. A user is thus able to "feel" that the closure device is being properly closed. FIG. 14 illustrates the closure device of FIG. 13 when the wings of the male fastening strip have traversed across one protrusion 258 of the female fastening strip 231. FIG. 15 shows the closure device of FIG. 13 in a fully occluded position.

As shown, the female fastening strip includes four protrusions 258, two on each side of the female closure element. However, the female closure element could include a greater or fewer number of protrusions, such as one, two three, four or more protrusions. The protrusions may have the same size or may be different sizes. For example, the protrusions may be sized such that the outermost protrusions are larger than the innermost protrusions, thus requiring slightly more force to push the wings over the outer protrusions. Alternatively, or in addition thereto, the protrusions may include colorants such as pigments. If the wings of the male fastening strip are opaque, the user will be able to see the protrusions when the closure device is deoccluded or partially occluded, but will not see the protrusions when the closure device is fully occluded. Thus, further visual indication of occlusion of the closure device will be provided. The innermost protrusions may be differently colored from the outermost protrusions which allows the user to visually observe the progression of occlusion of the closure device. The use of the protrusions and wings to provide a dynamically tactile indication of proper occlusion may be used with any of the embodiments in this application as appropriate.

Another feature of the invention is the spacing member 259 which provides a predetermined spacing between the fastening strips and also a predetermined tension among the closure elements. Referring to FIGS. 13–15, the base 238 includes a spacing member 259 and the base 247 includes an engagement surface 260 for the spacing member. The spacing member 259 extends from the base a predetermined distance and is located between the webs 240, 241. The engagement surface 260 is located between the webs 250, 251 and includes a groove which engages the spacing member 259.

Referring to FIG. 14, as the user applies forces to the fastening strips, the spacing member 259 contacts the engagement surface 260. In order to hold the fastening strips in an occluded position, the female hooks 242, 244 must engage the male hooks 252, 254. As the user continues to apply the forces, the female webs 240, 241 deflect outwardly and the male webs 250, 251 deflect inwardly in order to allow the female hooks 242, 244 and the male hooks 252, 254 to pass each other. In addition, the hooks may also deflect during this process.

As the user continues to apply the forces, the female hooks 242, 244 engage the male hooks 252, 254 as shown in FIG. 15. During the process, the base of the male fastening strip deflects inward and forms an inward deformation 257. During the process, the spacing member 259 may also deflect as shown in FIG. 15. The spacing member performs several functions. The spacing member 259 maintains a predetermined distance between the fastening strips. The spacing member 259 also maintains a predetermined depth for the deformation 257 by preventing the deformation 257 from moving too close to the other fastening strip. The spacing member 259 also maintains tension between the female hooks 242, 244 and the male hooks 252, 254.

The deformation 257 is retained because the male wings 237 are more rigid than the base and because the male wings 237 are prevented from further outward movement by the wings 235. In addition, the forces exerted by the deflected base and the deflected spacing member 259 are less than the force required to disengage the hooks. In order to facilitate the deflection of the base, the fastening strip may include notches 256.

The spacing member 259 may be located on the male fastening strip 230 and the engagement surface 260 on the female fastening strip 231 as shown in FIGS. 13–15. Conversely, the spacing member may be located on the female fastening strip and the engagement surface on the male fastening strip. The spacing member 259 and the engagement surface 260 may also include color to provide the user with a visual indication that occlusion has occurred as noted above. In addition, the spacing member may be used with any of the embodiments in this application where appropriate.

Figure 17:
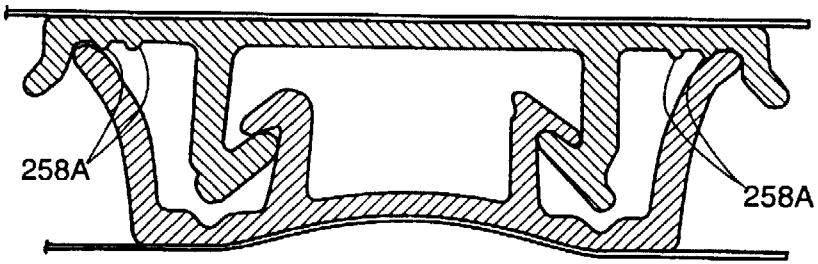
FIG. 17 is a cross-sectional view of another embodiment which includes a plurality of protrusions.
Figure 16:
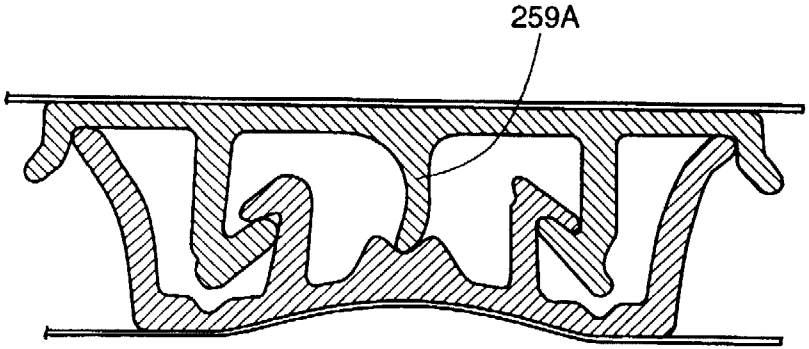
FIG. 16 is a cross-sectional view of another embodiment which includes a spacer member.

Furthermore, the spacing member 259 and the protrusions 258 can be used independently. For example, FIG. 16 illustrates a closure device which includes a spacing member 259A similar to FIGS. 13–15 but does not include protrusions. Conversely, FIG. 17 illustrates a closure device which includes protrusions 258A similar to FIGS. 13–15 but does not include a spacing member.

Figure 18:
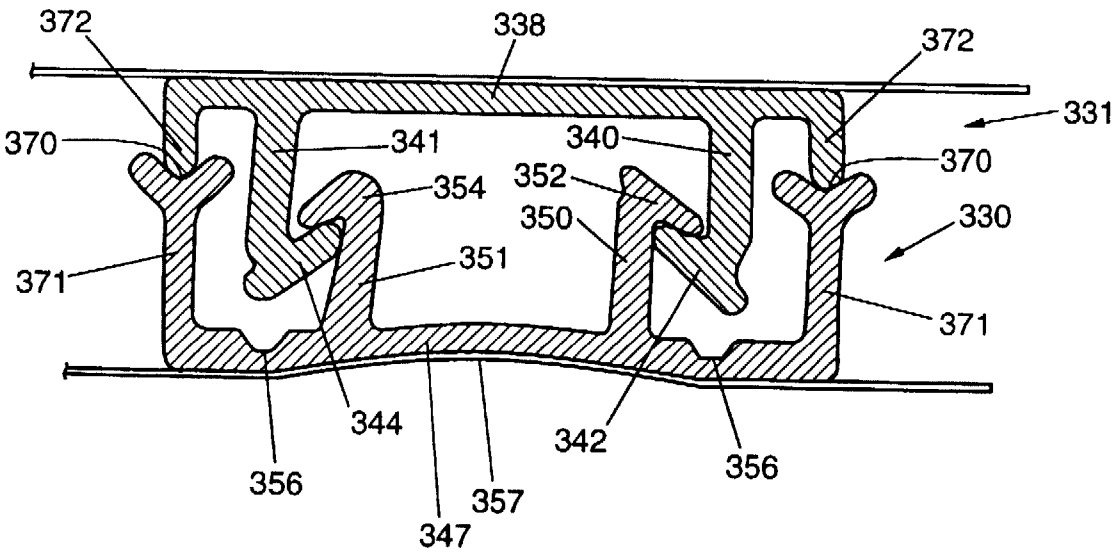
FIG. 18 illustrates a closure device according to the present invention in which the wings of the male fastening strip are Y-shaped.

Other embodiments of the closure elements and wings may be provided. For example, FIG. 18 illustrates a closure device in which the wings 371 of the male fastening strip are Y-shaped. The wings 372 of the female fastening strip are spaced so as to engage the grooves 370 in the wings 371. Referring to FIG. 18, the female fastening strip 331 includes a female closure element 334 similar to female closure element 34 shown in FIG. 2. The female closure element 334 includes a base portion 338 and a pair of webs 340, 341 similar to base 38 and webs 40, 41 in FIG. 2. The webs 340, 341 include female hook portions 342, 344 similar to hooks 42, 44 in FIG. 2. The fastening strip 331 also includes a wing 372 on each side of the female closure element 334.

The male fastening strip 330 includes a male closure element 336 similar to male closure element 36 in FIG. 3. The male closure element 336 includes a base portion 347 and a pair of webs 350, 351 similar to base 47 and webs 50, 51 in FIG. 3. The webs 350, 351 include male hook portions 352, 354 similar to hooks 52, 54 in FIG. 3. The fastening strip 330 also includes a wing 371 on each side of the male closure element 336. The wing 371 includes a groove 370 to engage the wing 372.

FIG. 18 shows the closure device in occluded position. As noted above, the user applies compression forces to the fastening strips in order to occlude the closure device. As the user occludes the fastening strips, the male wings 371 engage the female wings 372 as shown in FIG. 18. In order to hold the fastening strips in an occluded position, the female hooks 342, 344 must engage the male hooks 352, 354 as noted above for hooks 42, 44, 52, 54. During this process, the base of the male fastening strip deflects inward and forms an inward deformation 357. The deformation 357 is retained because the male wings 371 are more rigid than the base and because the male wings 371 are held in position by the groove 370 engaging the wings 372. The groove 370 prevents the wings 371 from moving laterally with respect to wings 372. In order to facilitate the deflection of the base, the fastening strip may include notches 356.

Figure 19:
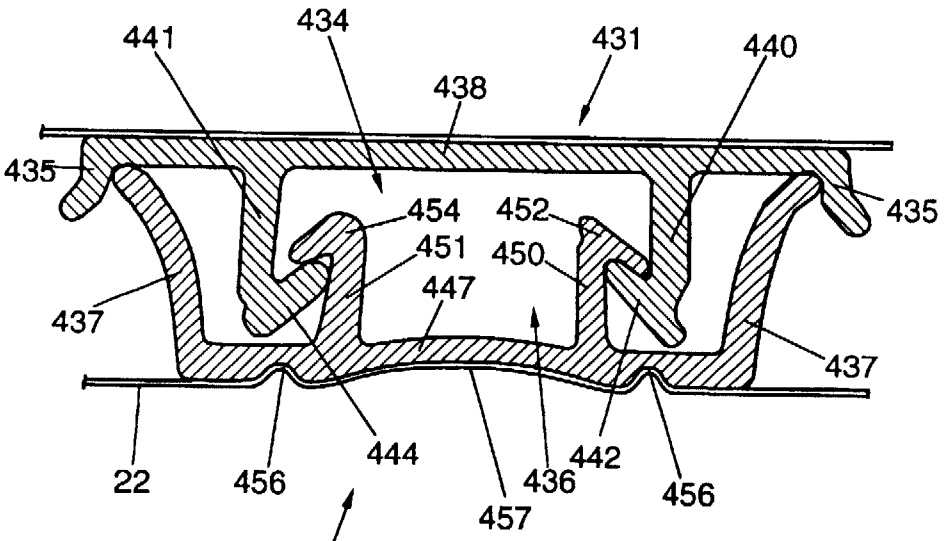
FIG. 19 is a cross-sectional view of another embodiment of a closure device of the present invention in which the notches are located on the non-mating side of the fastening strip.

In another embodiment of the present invention, the notches may be disposed on the other side of the male fastening strip. FIG. 19 illustrates such a male fastening strip 430 including the notches 456 which are disposed on the outside of male fastening strip 430. The notches 456 may also be formed into the side wall 22 of the plastic bag.

Referring to FIG. 19, the female fastening strip 431 includes a female closure element 434 similar to female closure element 34 shown in FIG. 2. The female closure element 434 includes a base portion 438 and webs 440, 441 similar to base 38 and webs 40, 41 in FIG. 2. The webs 440, 441 include female hook portions 442, 444 similar to hooks 42, 44 in FIG. 2. The fastening strip 431 also includes wings 435 similar to wings 35 in FIG. 2.

The male fastening strip 430 includes a male closure element 436 similar to male closure element 36 in FIG. 3. The male closure element 436 includes a base portion 447 and a pair of webs 450, 451 similar to base 47 and webs 50, 51 in FIG. 3. The webs 450, 451 include male hook portions 452, 454 similar to hooks 52, 54 in FIG. 3. The fastening strip 430 also includes a wing 437 on each side of the male closure element 436 similar to the wings 37 in FIG. 3.

The fastening strip 430 includes notches 456 which are disposed on the non-mating side of the fastening strip 430. The notches are also formed into the side wall 22 of the plastic bag.

During occlusion, the user applies compression forces to the fastening strips as noted above. As the user occludes the fastening strips, the male wings 437 engage the female wings 435 as shown in FIG. 19. In order to hold the fastening strips in an occluded position, the female hooks 442, 444 must engage the male hooks 452, 454 as noted above for hooks 42, 44, 52, 54. During this process, the base of the male fastening strip deflects inward and forms an inward deformation 457. The deformation 457 is retained because the male wings 437 are more rigid than the base and because the male wings 437 are prevented from further outward movement by the wings 435. In addition, the force exerted by the deflected base is less than the force required to disengage the hooks. The notches 456 facilitate the deflection of the base.

In addition, the fastening strip 430 provides an additional tactile sensation. The notches 456 on each side of the deformation 457 assist the user in locating and maintaining contact with the deformation. Furthermore, depending upon the configuration of the notches, the notches may also provide tactile confirmation of the occlusion. For example, the notches may be narrow when the closure device is not occluded. When the closure device is occluded, the notches may become wide enough so that the user can tactilely determine the difference between the narrow notch (i.e. unoccluded) and the wide notch (i.e. occluded).

The base flexes to create a deformation because at least a portion of the base is less rigid than the other portions of the fastening strip. The rigidity of the base can be reduced by having an area of reduced cross-section in the base. This area would be more likely to flex than the surrounding areas. An area of reduced cross-section can be achieved by using notches. In addition, an area of reduced cross-section can be achieved by chemical etching of at least a portion of the fastening strip. The chemical etching could be performed by using a chemical solvent. For example, chemical solvents for polyethylene are Decolin, a strong nitric acid or a strong base.

Figure 19A:
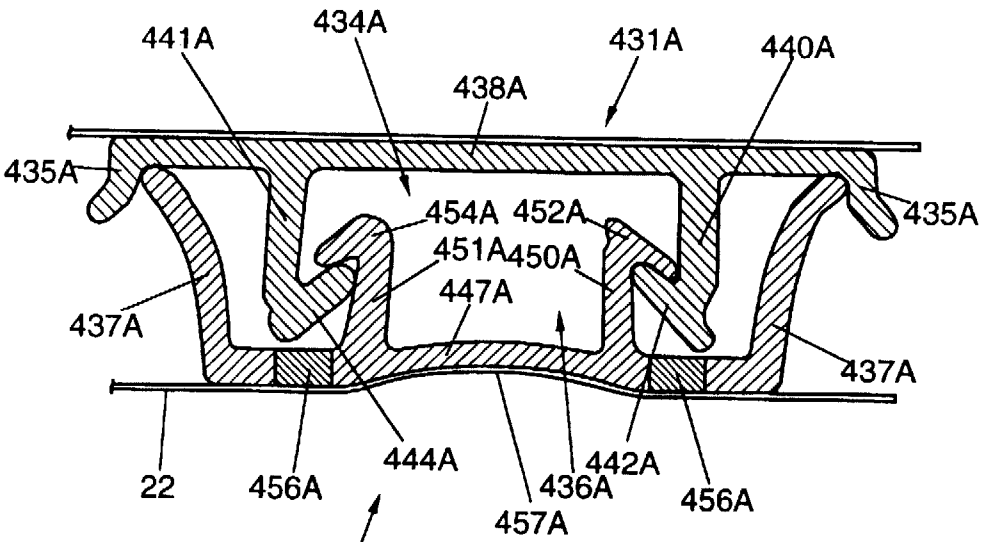
FIG. 19A is a cross-sectional view of another embodiment of a closure device of the present invention with coextruded portions and an inward deformation.

The rigidity of the base can also be reduced by having an area in the base which is made of a different second material, such as, by coextrusion. Referring to FIG. 19A, the male fastening strip 430A includes a base 447A which is made of a first material and coextruded portions 456A which are made of a second material. The second material would be more likely to flex than the first material with the application of the same force, i.e. the first material would have a different modulus of elasticity than the second material. Therefore, the base would more likely flex at the location of the second material.

Referring to FIG. 19A, the female fastening strip 431A includes a female closure element 434A similar to female closure element 434 shown in FIG. 19. The female closure element 434A includes a base portion 438A and webs 440A, 441A similar to base 438 and webs 440, 441 in FIG. 19. The webs 440A, 441A include female hook portions 442A, 444A similar to hooks 442, 444 in FIG. 19. The fastening strip 431A also includes wings 435A similar to wings 435 in FIG. 19.

The male fastening strip 430A includes a male closure element 436A similar to male closure element 436 in FIG. 19. The male closure element 436A includes a base portion 447A and a pair of webs 450A, 451A similar to base 447 and webs 450, 451 in FIG. 19. The webs 450A, 451A include male hook portions 452A, 454A similar to hooks 452, 454 in FIG. 19. The fastening strip 430A also includes a wing 437A on each side of the male closure element 436A similar to the wings 437 in FIG. 19. As noted above, the fastening strip 430A includes extruded portions 456A.

During occlusion, the user applies compression forces to the fastening strips as noted above. As the user occludes the fastening strips, the male wings 437A engage the female wings 435A as shown in FIG. 19A. In order to hold the fastening strips in an occluded position, the female hooks 442A, 444A must engage the male hooks 452A, 454A as noted above for hooks 442, 444, 452, 454. During this process, the base of the male fastening strip deflects inward and forms an inward deformation 457A. The deformation 457A is retained because the male wings 437A are more rigid than the base and because the male wings 437A are prevented from further outward movement by the wings 435A. In addition, the force exerted by the deflected base is less than the force required to disengage the hooks. The coextruded portions 456A facilitate the deflection of the base.

Figure 22A:
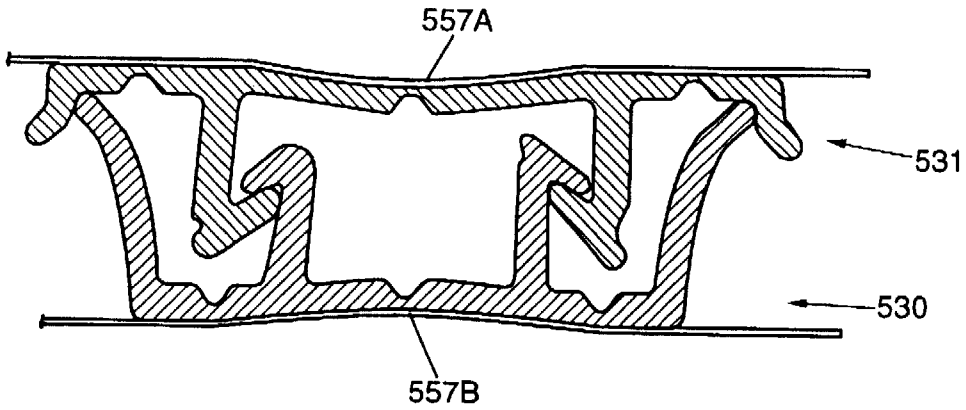
FIG. 22A is a cross-sectional view of another embodiment with a deformation in both fastening strips.
Figure 22B:
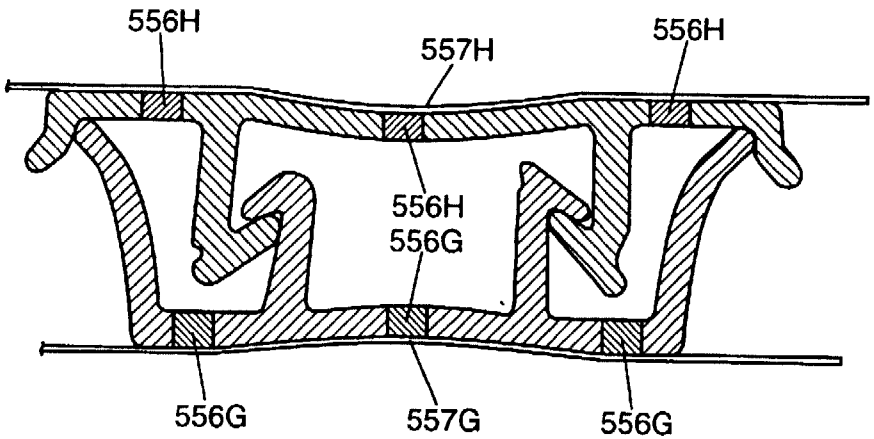
FIG. 22B is a cross-sectional view of another embodiment with coextruded portions and with a deformation in both fastening strips.
Figure 28A:
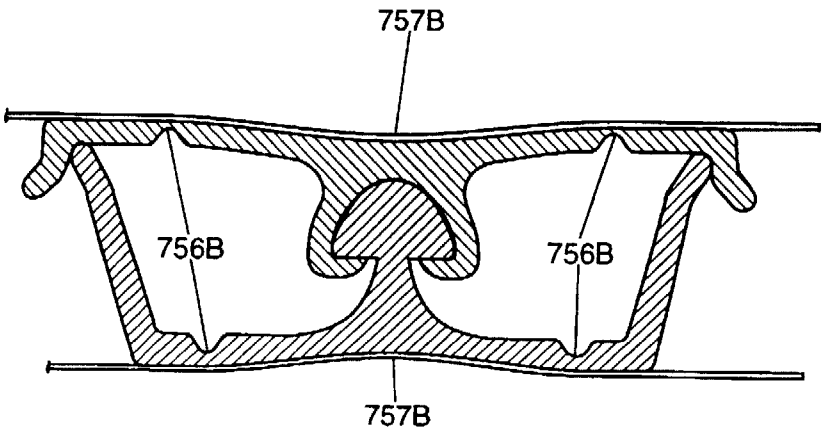
FIG. 28A is a cross-sectional view of another embodiment with a deformation in both fastening strips.
Figure 28B:
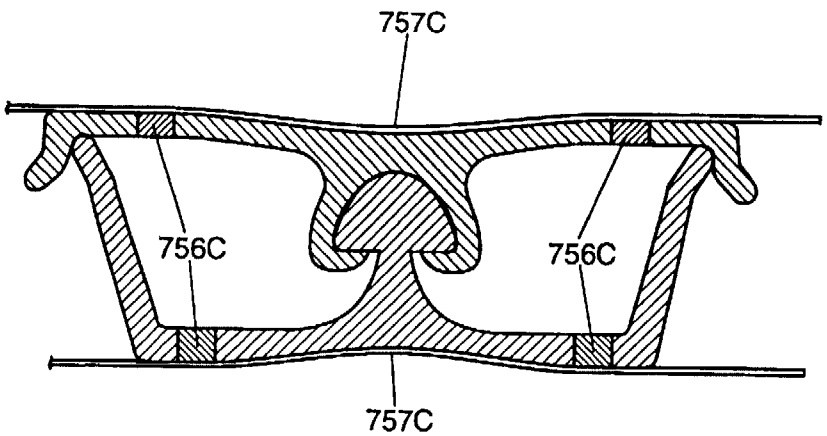
FIG. 28B is a cross-sectional view of another embodiment with coextruded portions and with a deformation in both fastening strips.
Figure 34A:
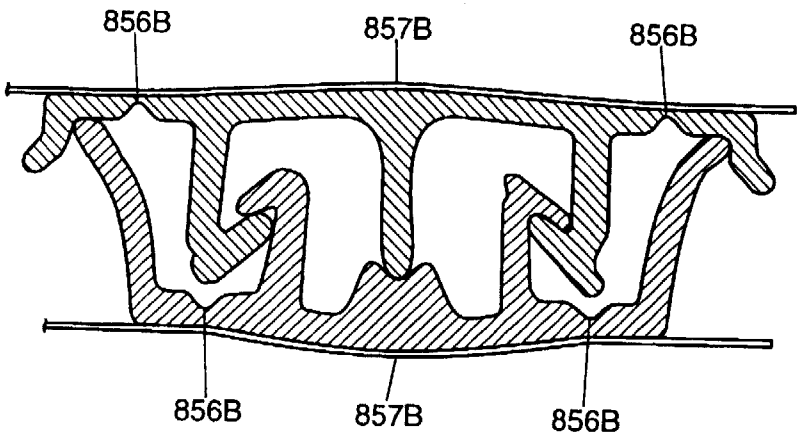
FIG. 34A is a cross-sectional view of another embodiment with an outward deformation in both of the fastening strips.
Figure 34B:
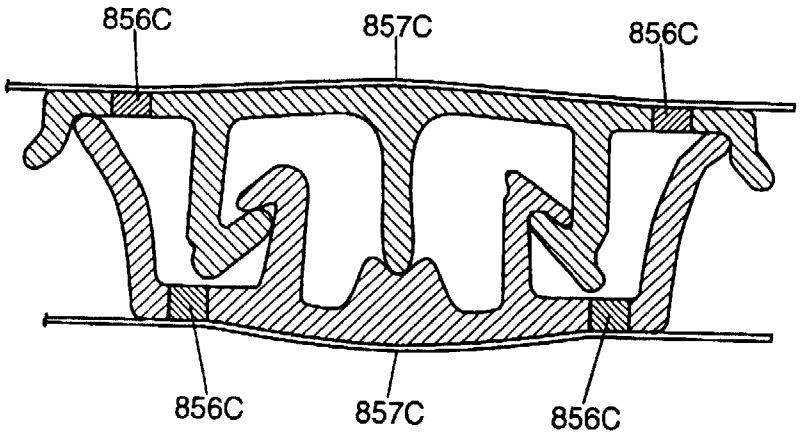
FIG. 34B is a cross-sectional view of another embodiment with coextruded portions and with an outward deformation in both of the fastening strips.

In addition, the coextruded portion may be continuous along the length of the fastening strip or the coextruded portion may be discontinuous along the length to provide an intermittent deformation effect. Furthermore, the second material could be disposed parallel to the longitudinal axis of the fastening strip as in FIG. 19A. In other embodiments, the second material could be disposed perpendicular to the longitudinal axis of the fastening strip as in U.S. Pat. No. 5,138,750 which is incorporated herein by reference. Finally, FIGS. 22B, 28B and 34B illustrate other embodiments of closure devices with coextruded portions.

Figure 20:
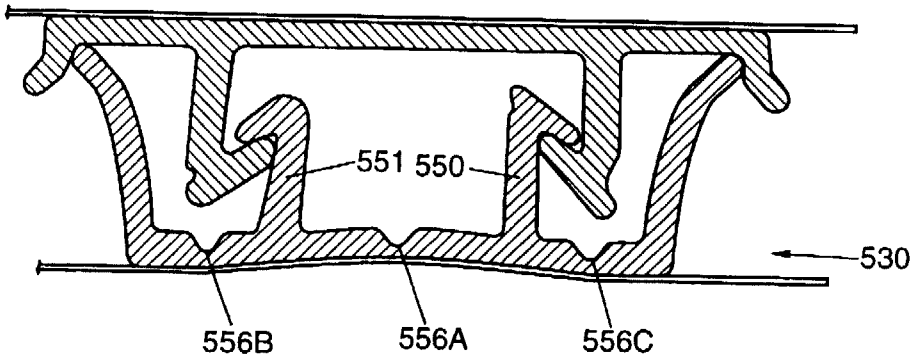
FIG. 20 is a cross sectional view of another embodiment of the present invention which includes a notch between the webs.
Figure 21:
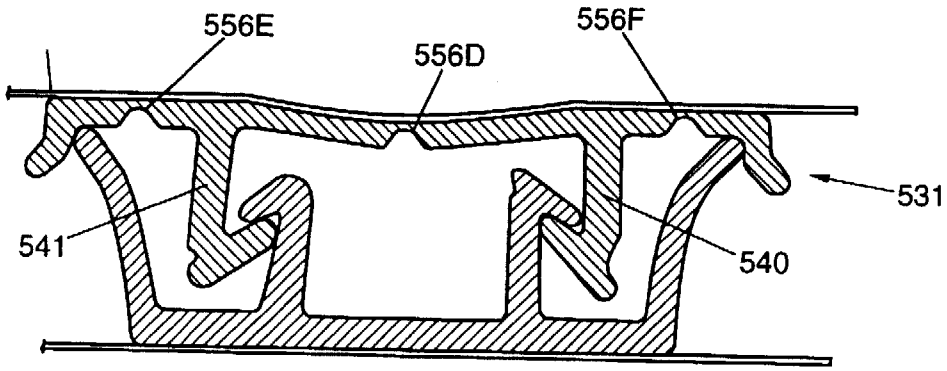
FIG. 21 is a cross-sectional view of another embodiment of the present invention which includes a notch between the webs.

The notch or notches may be placed in various locations on the fastening strip. Referring to FIG. 20, the male fastening strip 530 includes a notch 556A located between webs 550, 551. The notch 556A may be used in conjunction with one or more of the other notches 556B, 556 C or the notch 556A may be used without the other notches 556B, 556C. The notch 556A will facilitate the deflection of the base to form the deformation. Conversely, notches may be included on the female fastening strip in order to form the deformation on the female fastening strip. Referring to FIG. 21, the female fastening strip 531 includes a notch 556D located between webs 540, 541. The notch 556D may be used in conjunction with one or more of the other notches 556E, 556F or the notch 556D may be used without the other notches.

Furthermore, if a deformation or deformations are desired on both sides of the closure device, notches and/or coextruded portions may be included on both the male fastening strip and the female fastening strip. For example, referring to FIG. 22A, the closure device includes the male fastening strip 530 from FIG. 20 and the female fastening strip 531 from FIG. 21 to form deformations 557A, 558B on each side of the closure device. As another example, referring to FIG. 22B, the closure device includes a male fastening strip with coextruded portions 556G and a female fastening strip with coextruded portions 556H to form deformations 557G, 557H on each side of the closure device.

Figure 23:
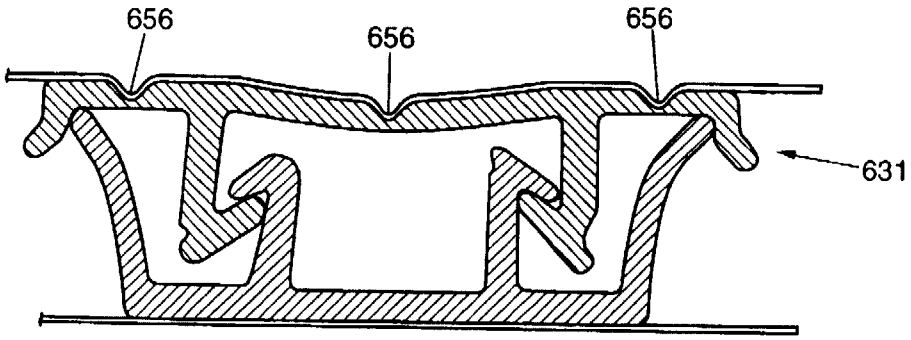
FIG. 23 is a cross-sectional view of another embodiment of the present invention which includes a notch between the webs and on the non-mating side of the fastening strip.
Figure 24:
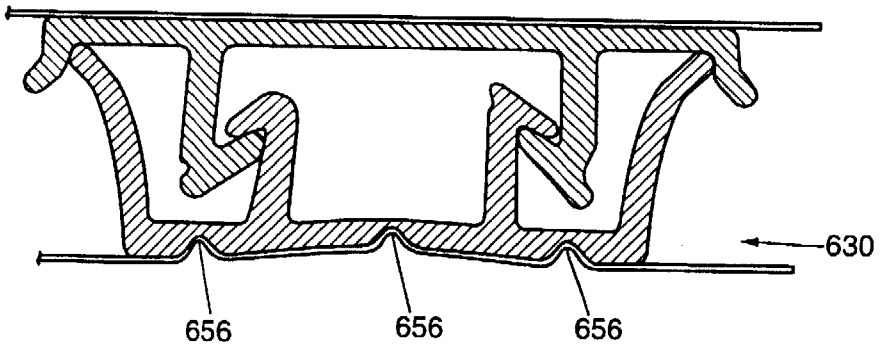
FIG. 24 is a cross sectional view of another embodiment of the present invention which includes a notch between the webs and on the non-mating side of the fastening strip.
Figure 25:
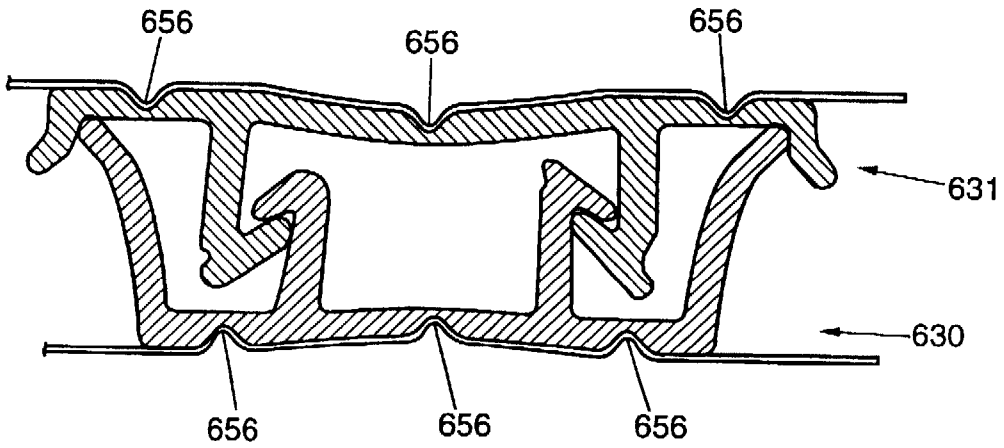
FIG. 25 is a cross-sectional view of another embodiment which includes notches on the non-mating sides of the fastening strips and a deformation on both fastening strips.

Notches in various locations on the male fastening strip and/or the female fastening strip may be used with any of the embodiments described herein as appropriate. For example, referring to FIGS. 23, 24 and 25, the fastening strips 630, 631 include notches 656 on the nonmating sides of the fastening strips.

The notches may have various configurations. For example, the notches may be composed of arcuate and linear segments, such as, notch 56 in FIG. 3. As another example, the notch may be composed of arcuate segments, such as, notch 156 in FIG. 9 or notch 256 in FIG. 13. As a further example, the notch may be a slit, such, as notches 956A, 956B, 1056A, 1056B in FIGS. 38A, 38B, 39A and 39B. For polyethylene the preferred notch depth should be no less than 15% of the base thickness to maintain the integrity of the base. In addition, the notch may be continuous along the length of the fastening strip or the notch may be discontinuous along the length to provide an intermittent deformation effect.

Figure 26:
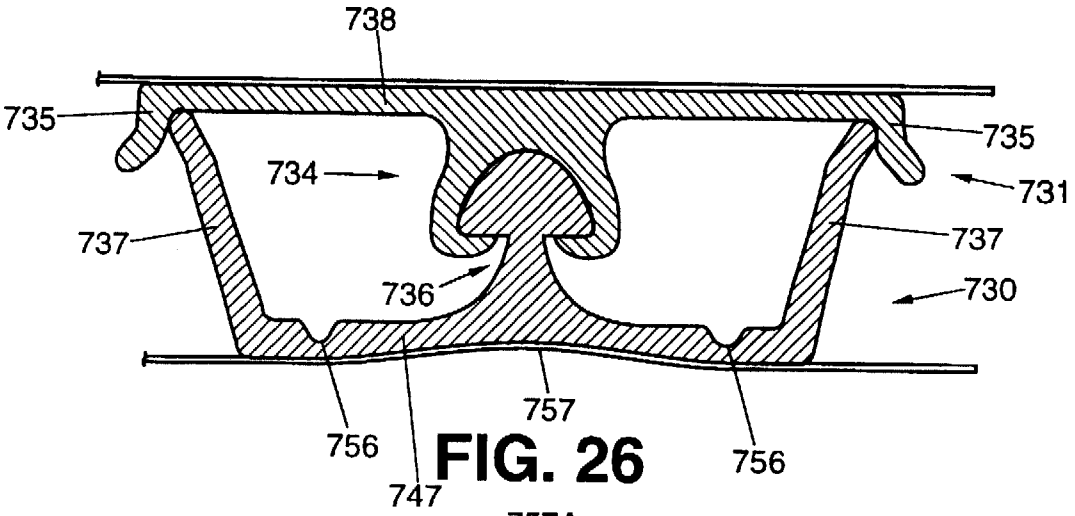
FIG. 26 is a cross-sectional view of another embodiment which includes another type of closure element.

In another embodiment, the closure device may include other types of closure elements. Referring to FIG. 26, a male fastening strip 730 includes a male closure element 736 and a female fastening strip 731 includes a female closure element 734. The closure elements 734, 736 are known and described in U.S. Pat. Nos. 3,198,228 (which was reissued as Re. 28,969), 4,736,496 and 5,363,540 which are incorporated herein by reference. These closure elements 734, 736 are sometimes referred to as "arrowhead" closure elements. The remaining components of the fastening strips 730, 731, such as, the wings 735, 737, the bases 738, 747 and the notches 756, are similar to the similarly numbered components 35, 37, 38, 47, 56 in FIGS. 2 and 3. When the fastening strips 730, 731 are occluded, a deformation 757 is formed along the fastening strip 730.

During occlusion, the user applies compression forces to the fastening strips as noted above. As the user occludes the fastening strips, the male wings 737 engage the female wings 735 as shown in FIG. 26. In order to hold the fastening strips in an occluded position, the female closure element 734 engages the male closure element 736. During this process, the base of the male fastening strip deflects inward and forms an inward deformation 757. The deformation is retained because the male wings 737 are more rigid than the base and because the male wings 737 are prevented from further outward movement by the female wings 735. In addition, the force exerted by the deflected base is less than the force required to disengage the closure elements. The notches 756 facilitate the deflection of the base.

Figure 27:
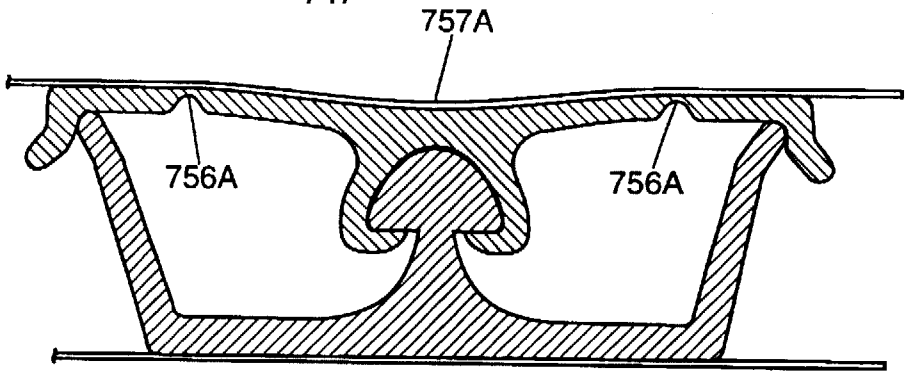
FIG. 27 is a cross-sectional view of another embodiment which includes the closure element in FIG. 26.
Figure 29:
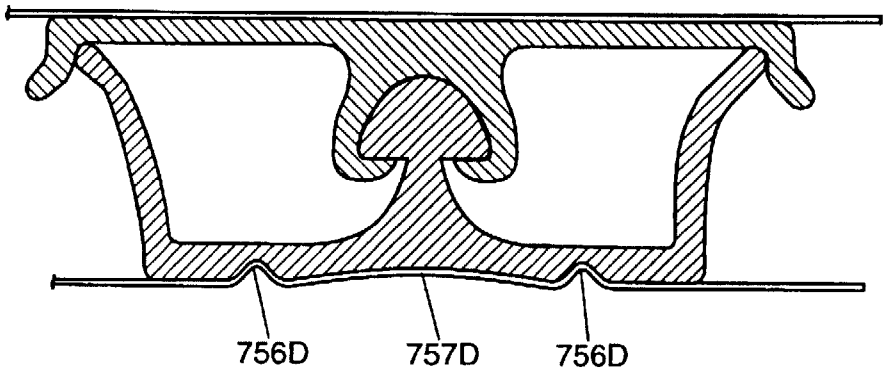
FIG. 29 is a cross-sectional view of another embodiment with a deformation in one of the fastening strips.
Figure 30:
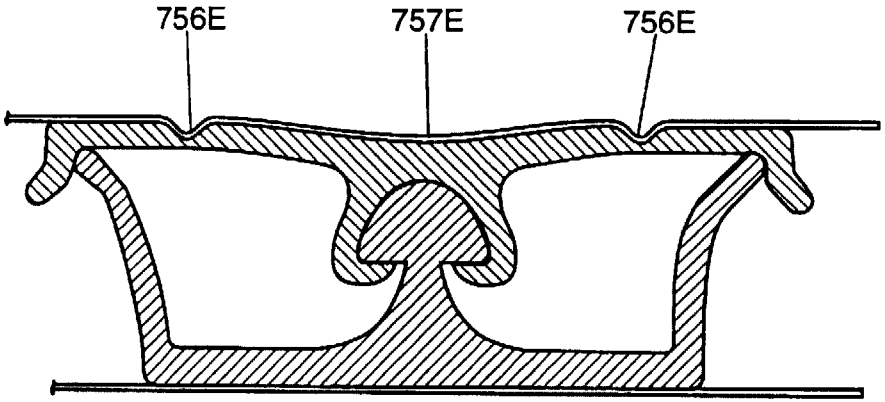
FIG. 30 is a cross-sectional view of another embodiment with a deformation in one of the fastening strips.
Figure 31:
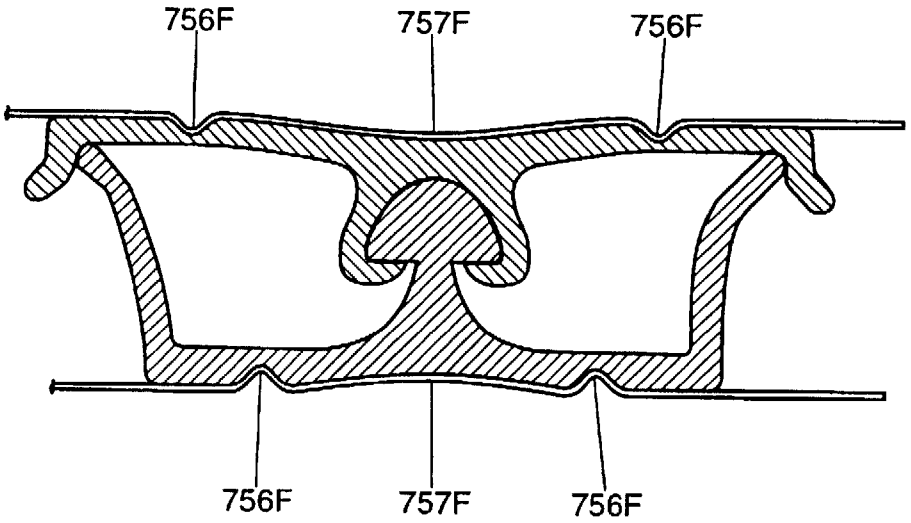
FIG. 31 is a cross-sectional view of another embodiment with a deformation in both of the fastening strips.

FIGS. 27–31 illustrate other embodiments of the invention using the arrowhead closure elements 734, 736 and having different locations for the deformations and notches. For example, FIG. 27 shows the notches 756A and deformation 757A on the female fastening strip. FIG. 28A shows the notches 756B and deformations 757B on both the fastening strips. FIG. 28B shows coextruded portions 756C and deformations 757C on both the fastening strips. FIGS. 29 and 30 show the notches 756D, 756E on the non-mating side and the deformation 757D, 757E on only one of the fastening strips. FIG. 31 shows the notches 756F on the non-mating sides and deformations 757F on both of the fastening strips.

Figure 32:
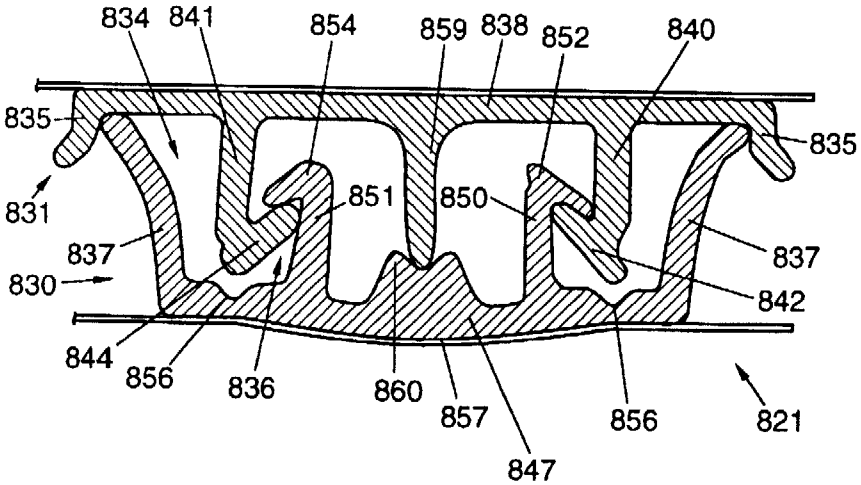
FIG. 32 is a cross-sectional view of another embodiment with an outward deformation in one of the fastening strips.

Referring to FIGS. 32–45, the closure device may also form an outward deformation when occluded. As shown in FIG. 32, the closure device 821 includes male and female fastening strips 830, 831 similar to fastening strips 230, 231 in FIG. 13. The female fastening strip 831 includes a female closure element 834 and a pair of wings 835 similar to female closure element 231 and wings 235 in FIG. 13. The male fastening strip 830 includes a male closure element 836 and a pair of wings 837 similar to male closure element 236 and wings 237 in FIG. 13. The female closure element 834 includes a base portion 838 and webs 840, 841 similar to base portion 238 and webs 240, 241 in FIG. 13. The webs 840, 841 include hook portions 842, 844 similar to hook portions 242, 244 in FIG. 13. The male closure element 836 includes a base portion 847 and webs 850, 851 similar to base portion 247 and webs 250, 251 in FIG. 13. The webs 850, 851 include hook portions 852, 854 similar to hook portions 252, 254 in FIG. 13. The base portion 847 may be provided with notches 856 which are similar to notches 256 in FIG. 13.

A spacing member 859 provides a predetermined spacing between the fastening strips and also a predetermined tension among the closure elements. Referring to FIG. 32, the base 838 includes a spacing member 859 and the base 847 includes an engagement surface 860 for the spacing member. The spacing member 859 extends from the base a predetermined distance and is located between the webs 840, 841. The engagement surface 860 is located between the webs 850, 851 and includes a groove which engages the spacing member 859.

Referring to FIG. 32, as the user applies forces to the fastening strips, the spacing member 859 contacts the engagement surface 860. In order to hold the fastening strips in an occluded position, the female hooks 842, 844 must engage the male hooks 852, 854. As the user continues to apply the forces, the female webs 840, 841 deflect outwardly and the male webs 850, 851 deflect inwardly in order to allow the female hooks 842, 844 and the male hooks 852, 854 to pass each other. In addition, the hooks may also deflect during this process.

As the user continues to apply the forces, the female hooks 842, 844 engage the male hooks 852, 854 as shown in FIG. 32. During the process, the base of the male fastening strip deflects outward and forms an outward deformation 857. During the process, the spacing member 859 may also deflect. The spacing member performs several functions. The spacing member 859 maintains a predetermined distance between the fastening strips. The spacing member 859 also maintains a predetermined height for the deformation 857. The spacing member 859 also maintains tension between the female hooks 842, 844 and the male hooks 852, 854.

The deformation 857 is retained because the male wings 837 are more rigid than the base and because the male wings 837 are prevented from further outward movement by the wings 835. In addition, the forces exerted by the deflected base and the deflected spacing member 859 are less than the force required to disengage the hooks. In order to facilitate the deflection of the base, the fastening strip may include notches 856.

The spacing member 859 and the engagement surface 860 may also include color to provide the user with a visual indication that occlusion has occurred as noted above. In addition, the spacing member may be used with any of the embodiments in this application where appropriate.

Figure 33:
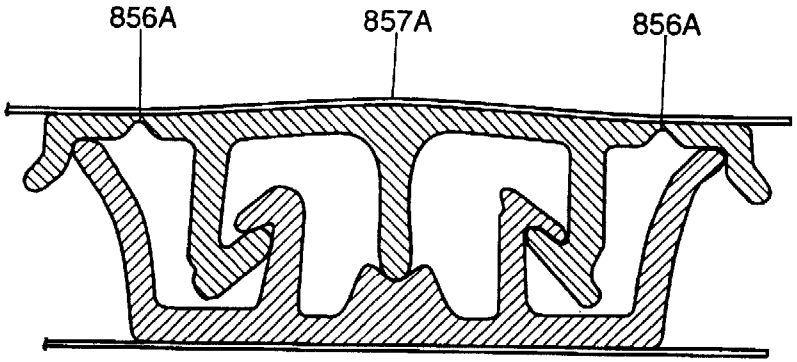
FIG. 33 is a cross-sectional view of another embodiment with an outward deformation in one of the fastening strips.
Figure 36:
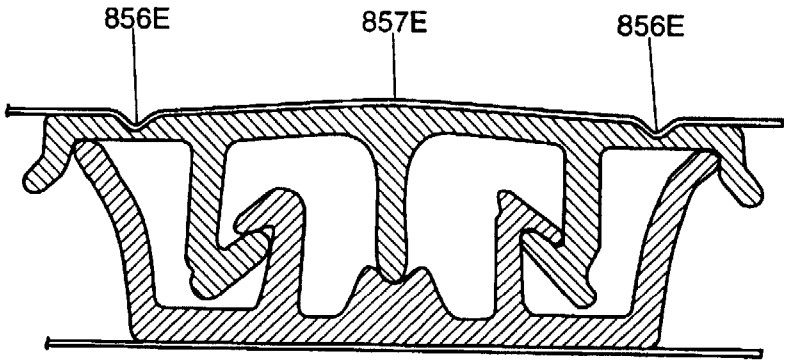
FIG. 36 is a cross-sectional view of another embodiment with an outward deformation in one of the fastening strips.
Figure 35:
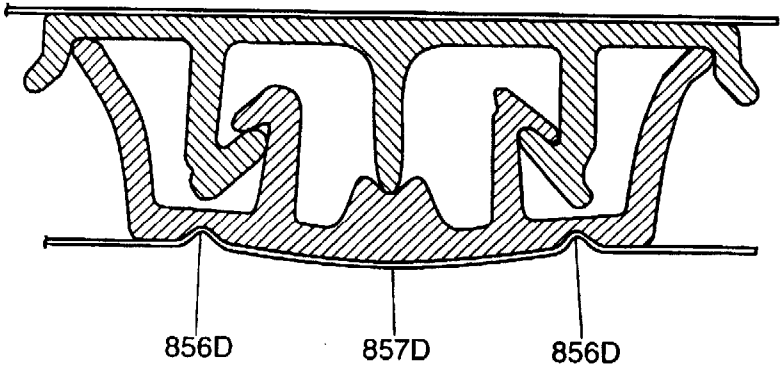
FIG. 35 is a cross-sectional view of another embodiment with an outward deformation in one of the fastening strips.
Figure 37:
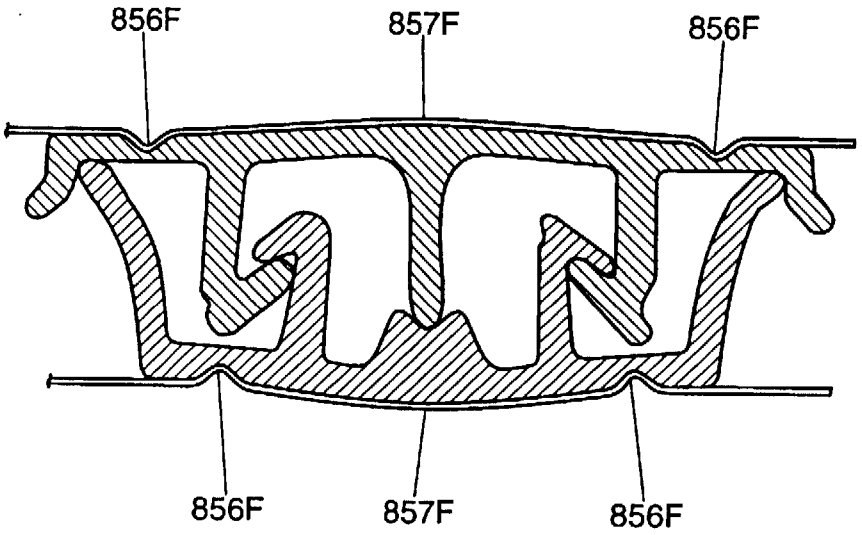
FIG. 37 is a cross-sectional view of another embodiment with an outward deformation in both of the fastening strips.

FIGS. 33–37 illustrate other embodiments of the invention using the spacing member 859 and having different locations for the deformations and notches. For example, FIG. 33 shows the notches 856A and outward deformation 857A on the female fastening strip. FIG. 34A shows the notches 856B and outward deformations 857B on both the fastening strips. FIG. 34B shows the coextruded portions 856C and the outward deformations 856C on both the fastening strips. FIGS. 35 and 36 show the notches 856D, 856E on the non-mating side and the deformation 857D, 857E on only one of the fastening strips. FIG. 37 shows the notches 856F on the non-mating sides and deformations 857F on both of the fastening strips. In addition, the closure device may include other closure elements, such as, the arrowhead closure elements, and form an outward deformation when occluded.

Figure 38A:
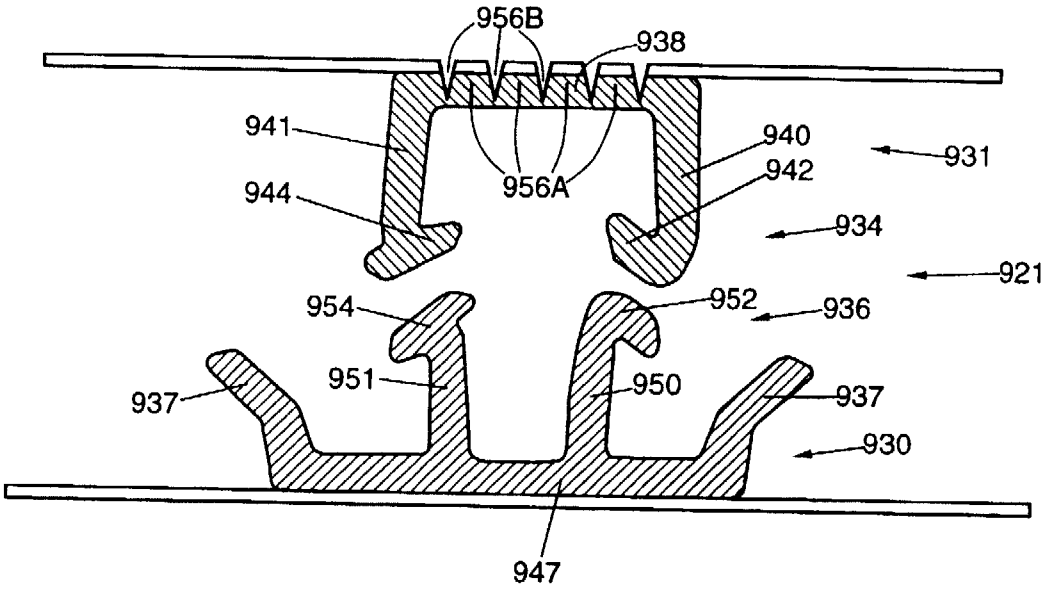
FIG. 38A is a cross-sectional view of another embodiment of the closure device in the unoccluded position.
Figure 38B:
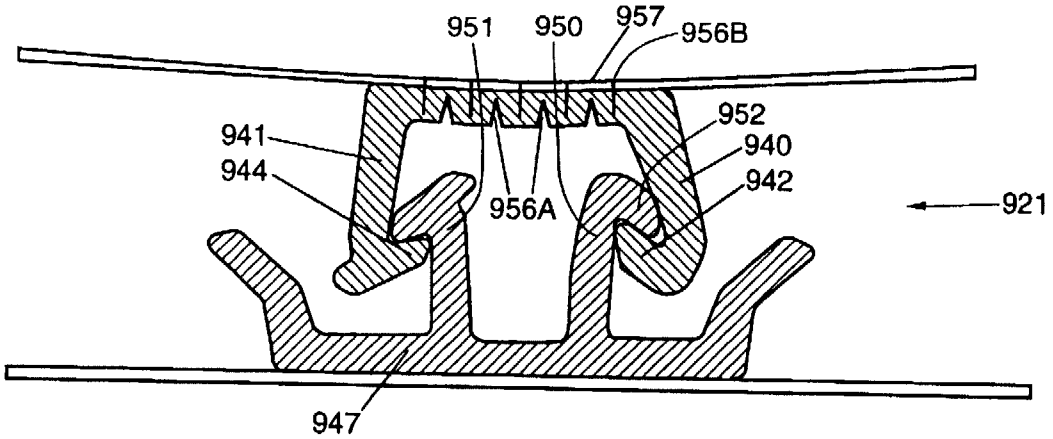
FIG. 38B is a cross-sectional view of the closure device in FIG. 38A in the occluded position with an inward deformation on one of the fastening strips.

FIGS. 38A and 38B illustrate another embodiment of a closure device which has an inward deformation when occluded. The closure device 921 includes a male fastening strip 930 and a female fastening strip 931. The female fastening strip 931 includes a female closure element 934.

The female closure element 934 includes a base portion 938 and a pair of webs 940, 941 extending from the base portion 938. The webs 940, 941 include hook portions 942, 944 extending from the webs. The base 938 may also include notches or slits 956A on the mating side and notches or slits 956B on the non-mating side.

The male fastening strip 930 includes a male closure element 936. The male closure element 936 includes a base portion 947 and a pair of webs 950, 951 extending from the base portion 947. The webs 950, 951 include hook portions 952, 954 extending from the webs. The male fastening strip 930 may also include wings 937 to guide the webs of the female closure element.

FIG. 38B illustrates the closure device 921 in the occluded position with an inward deformation. As the user applies forces to the fastening strips, the webs 940, 941 deflect outwardly in order to allow the hooks to pass each other. In addition, the hooks may also deflect during this process. As the user continues to apply the forces, the hooks engage as shown in FIG. 38B. During this process, the base 938 deflects inward and forms an inward deformation 957.

The deformation 957 is retained because the webs 940, 941, 950, 951 are more rigid than the base 938. Specifically, the distance between the hooks 952, 954 is greater than the distance between the webs 940, 941 when the fastening strip 931 is in the unoccluded position. The webs 940, 941 are urged away from each other in order to fit over the hooks 952, 954. The webs are rigid in comparison to the base 938 and thus the webs 940, 941 are permitted to be urged away from each other. In this embodiment, the base is less rigid due to the notches 956A, 956B. The notches allow the base to flex inward to form the deformation. Specifically, the notches 956A open to permit the mating surface of the base to increase and the notches 956B close to permit the non-mating surface of the base to decrease. The forces exerted by the deflected base are less than the force required to disengage the hooks.

Figure 39A:
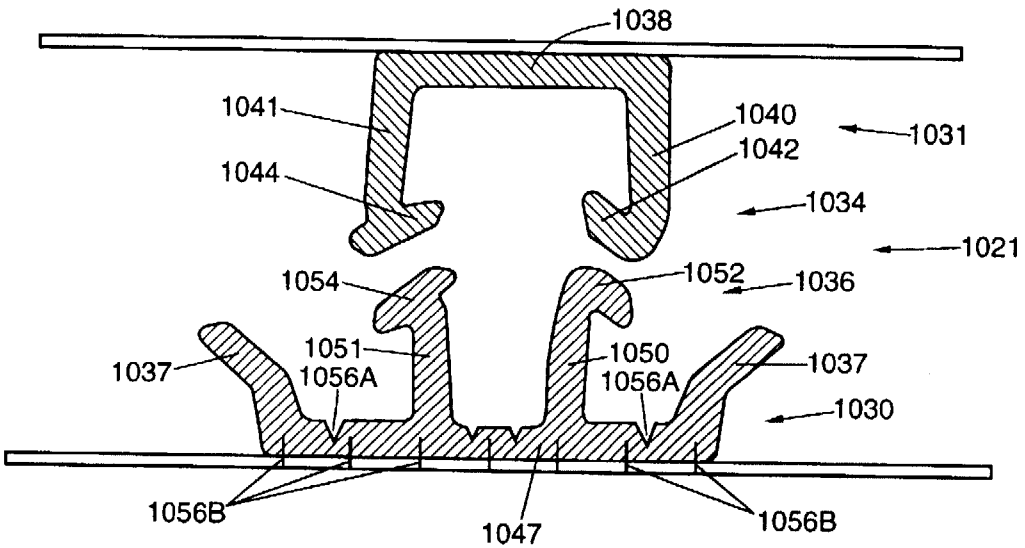
FIG. 39A is a cross-sectional view of another embodiment of the closure device in the unoccluded position.
Figure 39B:
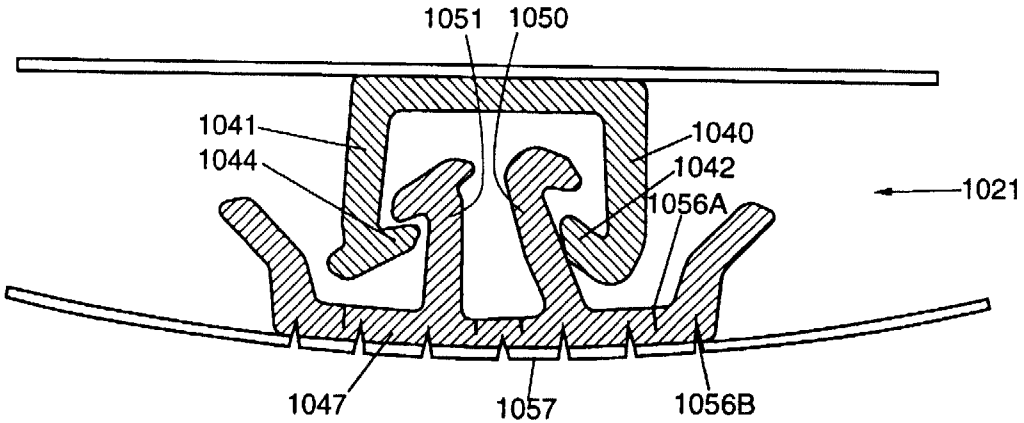
FIG. 39B is a cross-sectional view of the closure device in FIG. 39A in the occluded position with an outward deformation on one of the fastening strips.

FIGS. 39A and 39B illustrate another embodiment of a closure device which has an outward deformation when occluded. The closure device 1021 includes a male fastening strip 1030 and a female fastening strip 1031. The female fastening strip 1031 includes a female closure element 1034. The female closure element 1034 includes a base portion 1038 and a pair of webs 1040, 1041 extending from the base portion 1038. The webs 1040, 1041 include hook portions 1042, 1044 extending from the webs.

The male fastening strip 1030 includes a male closure element 1036. The male closure element 1036 includes a base portion 1047 and a pair of webs 1050, 1051 extending from the base portion 1047. The webs 1050, 1051 include hook portions 1052, 1054 extending from the webs. The male fastening strip 1030 may also include wings 1037 to guide the webs of the female closure element. The base 1047 may also include notches or slits 1056A on the mating side and notches or slits 1056B on the non-mating side.

FIG. 39B illustrates the closure device 1021 in the occluded position with an outward deformation. As the user applies forces to the fastening strips, the male webs 1050, 1051 deflect inwardly in order to allow the hooks to pass each other. In addition, the hooks may also deflect during this process. As the user continues to apply the forces, the hooks engage as shown in FIG. 39B. During this process, the base 1047 deflects outward and forms an outward deformation 1057.

The deformation 1057 is retained because the webs 1040, 1041, 1050, 1051 are more rigid than the base 1047. Specifically, the distance between the hooks 1042, 1044 is less than the distance between the webs 1050, 1051 when the fastening strip 1030 is in the unoccluded position. The webs 1050, 1051 are urged closer to each other in order to fit between the hooks 1042, 1044. The webs are rigid in comparison to the base 1047 and thus the webs 1050, 1051 are permitted to be urged closer to each other. In this embodiment, the base is less rigid due to the notches 1056A, 1056B. The notches allow the base to flex outward to form the deformation. Specifically, the notches 1056B open to permit the non-mating surface of the base to increase and the notches 1056A close to permit the mating surface of the base to decrease. The forces exerted by the deflected base are less than the force required to disengage the hooks.

Figure 40:
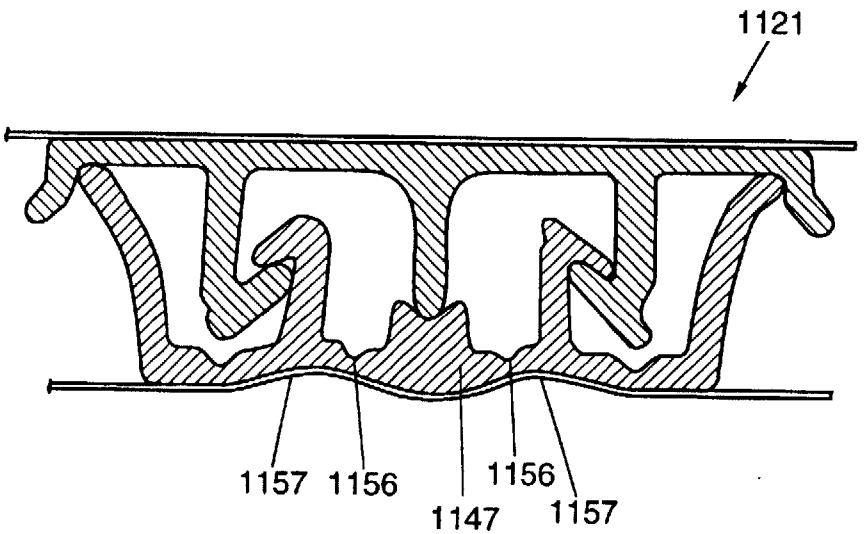
FIG. 40 is a cross-sectional view of another embodiment of the closure device with multiple deformations in one of the fastening strips.

Referring to FIG. 40, a closure device may also include multiple deformations upon occlusion of the closure device. In FIG. 40, the closure device 1121 includes two inward deformations 1157. The closure device 1121 is similar to the closure device in FIG. 16 except the closure device 1121 includes two additional notches 1156 to obtain additional flexibility in the base 1147.

Figure 42:
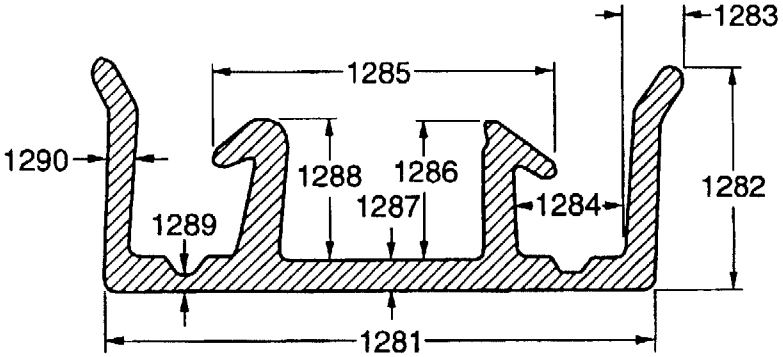
FIG. 42 illustrates a male fastening strip of a closure device according to the present invention.
Figure 41:
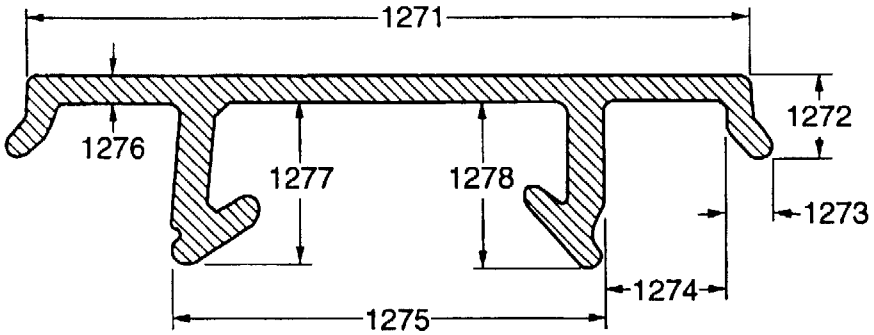
FIG. 41 illustrates a female fastening strip of a closure device according to the present invention.

FIGS. 41 and 42 illustrate the female and male fastening strips respectively of one embodiment of the closure device of the present invention. The representative dimensions of the various parameters are given as follows:

| PARAMETER | RANGE (mils) | PREFERRED (mils) |
|---|---|---|
| 1271 | 0.283–0.363 | 0.323 |
| 1272 | 0.007–0.047 | 0.027 |
| 1273 | 0.012–0.032 | 0.022 |
| 1274 | 0.024–0.094 | 0.059 |
| 1275 | 0.187–0.267 | 0.227 |
| 1276 | 0.010–0.016 | 0.013 |
| 1277 | 0.018–0.088 | 0.053 |
| 1278 | 0.016–0.086 | 0.051 |
| 1281 | 0.203–0.283 | 0.243 |
| 1282 | 0.029–0.099 | 0.064 |
| 1283 | 0.013–0.033 | 0.023 |
| 1284 | 0.015–0.065 | 0.040 |
| 1285 | 0.115–0.195 | 0.155 |
| 1286 | 0.022–0.052 | 0.037 |
| 1287 | 0.010–0.016 | 0.013 |
| 1288 | 0.023–0.053 | 0.038 |
| 1289 | 0.004–0.010 | 0.007 |
| 1290 | 0.010–0.016 | 0.013 |

The fastening strips may be manufactured by extrusion through a die that has the approximate dimensions given above, although the die should be made somewhat larger than the desired final dimensions of the fastening strip, inasmuch as shrinkage of the extruded fastening strip is likely upon cooling. The fastening strips of the closure device should be manufactured to have approximately uniform cross-sections. This not only simplifies the manufacturing of a device, but also contributes to the physical flexibility of the device, which is a desirable property in any event, and which is necessary to form a deformation in the fastening strip.

Generally, the closure elements of this invention may be formed from thermoplastic materials such as, for example, polyethylene, polypropylene, nylon, or the like, or from a combination thereof. Thus, resins or mixtures of resins such as high density polyethylene, medium density polyethylene and low density polyethylene may be employed to prepare the novel fastener of this invention. Preferably, the closure element is made from low density polyethylene. The selection of the thermoplastic material will be related to the closure design and its Young's Modulus and desired elasticity and flexibility correlated to provide the functionality of the closure as herein claimed.

When the fastener of the present invention is used in a sealable bag, the fastener and the films that form the body of the bag can be made from heat sealable material. The bag thus can be formed economically by heat sealing the aforementioned components to form the bag using thermoplastics of a type aforementioned for formation of the closure elements. Preferably, the bag is made from a mixture of high pressure, low density polyethylene and linear low density polyethylene.

The closure elements of the invention may be manufactured by extrusion or other known methods. The closure device can be manufactured as individual fastening strips for later attachment to a film, or the fastening strips can be manufactured integrally with a film. In addition, the closure elements can be manufactured with or without flange portions on one or both of the closure elements depending upon the intended use or expected additional manufacturing operations.

Generally, the closure device of this invention can be manufactured in a variety of forms to suit the intended use. In the practice of the instant invention, the closure device may be integrally formed with the sidewalls of a container, or connected to a container, by the use of any of many known methods. For example, a thermoelectric device can be applied to a film in contact with a flange portion of a closure element or the thermoelectric device can be applied to a film in contact with the base portion of a closure element having no flange portion, to cause a transfer of heat through the film to produce melting at the interface of the film and a flange portion or base portion of the closure element. The thermoelectric device can be heated rotary discs, traveling heater bands, resistance-heated slide wires, or the like. The connection between the film and the closure element can also be established by the use of hot melt adhesives, hot jets of air to the interface, ultrasonic heating, or other known methods. The bonding of the closure element to the film stock may be carried out either before or after the film is U-folded to form a bag. In any event, such bonding is done prior to side sealing the bags at the edges by conventional thermal cutting. In addition, the male and female closure elements can be positioned on opposite sides of a film. Such an embodiment would be suited for wrapping an object or a collection of objects such as wires. The male and female closure elements on a film generally should be parallel to each other, but this will depend on the intended use.

Thus, the present invention provides a closure device that overcomes the drawbacks inherent in the prior art. Specifically, the present invention affords a closure device that provides a static tactile confirmation of occlusion. Occlusion thus may be confirmed merely by feeling the closure device, even after the device has been occluded.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references and copending applications cited herein are hereby incorporated by reference in their entireties.

What is claimed is:

1. A closure device comprising first and second interlocking fastening strips arranged to be interlocked over a predetermined length, at least one of said fastening strips having a non-deformed position before occlusion of said closure device and having a deformation after occlusion of said closure device, said deformation providing tactile confirmation of occlusion of said closure device.

2. The invention as in claim 1 wherein said first fastening strip including a first closure element and further including a first wing extending from said first fastening strip;

said second fastening strip including a second closure element for mating with said first closure element, said second fastening strip further including a second wing for engaging with said first wing; whereby said first wing engages with said second wing such that at least a portion of said first fastening strip deflects when said first and second fastening strips interlock to thereby create a deformation in said first fastening strip.

3. The invention as in claim 2, wherein said first closure element comprises a pair of spaced-apart webs integrally attached to said first fastening strip and extending therefrom, said webs terminating in male hooks, said male hooks comprising male hook portions facing away from one another, and wherein said second closure element comprises a pair of spaced-apart webs integrally attached to said second fastening strip and extending therefrom, said webs terminating in female hooks, said female hooks comprising female hook portions facing towards one another to engage said male hooks.

4. The invention as in claim 3, wherein said at least one fastening strip includes a base and said base includes a flexure point which facilitates the formation of said deformation.

5. The invention as in claim 4, wherein said point is adjacent said first closure element.

6. The invention as in claim 4, wherein said point is between said first closure element and said first wing.

7. The invention as in claim 4, wherein said point is between said webs.

8. The invention as in claim 3, wherein said fastening strip includes a pair of first wings, a base and said base has two flexure points, one of said points located between said first closure element and one of said wings and the other of said points located between said first closure element and the other of said wings.

9. The invention as in claim 8, wherein said base includes a third flexure point and said third point is between said webs.

10. The invention as in claim 3, wherein one of said fastening strips includes a spacing member.

11. The invention as in claim 10, wherein said other of said fastening strips includes an engagement surface.

12. The invention as in claim 2, wherein said first closure element comprises a first web integrally attached to said first fastening strip and extending therefrom, said first web terminating in an arrowhead, said second closure element comprises a second web integrally attached to said second fastening strip and extending therefrom, said second web terminating in a mating configuration for said arrowhead.

13. The invention as in claim 12, wherein said at least one fastening strip includes a base and said base includes a flexure point which facilitates the formation of said deformation.

14. The invention as in claim 13, wherein said point is adjacent said first closure element.

15. The invention as in claim 13, wherein said point is between said first closure element and said first wing.

16. The invention as in claim 12, wherein said fastening strip includes a pair of first wings, a base and said base has two flexure points, one of said points located between said first closure element and one of said wings and the other of said points located between said first closure element and the other of said wings.

17. The invention as in claim 2, wherein said fastening strips are separated by a first distance when said first wing engages said second wing but said first closure element and second closure element are unoccluded, said fastening strips are separated by a second distance when said first closure element and said second closure element are occluded, said second distance is less than said first distance.

18. The invention as in claim 2, said first fastening strip including a pair of first wings integrally attached to said first fastening strip and extending therefrom, said first wings spaced apart on said first fastening strip, said second fastening strip including a pair of second wings integrally attached to said second fastening strip and extending therefrom, said second wings spaced apart on said second fastening strip so as to engage with said first wings.

19. The invention as in claim 2, wherein said first wings are Y-shaped.

20. The invention as in claim 2, wherein said first wings are curved.

21. The invention as in claim 2, wherein said second fastening strip includes a plurality of protrusions for dynamically engaging with said first wing.

22. The invention as in claim 2, wherein said closure device has two deformations.

23. The invention as in claim 22, wherein one of said deformations is on one of said fastening strips and the other of said deformations is on the other of said fastening strips.

24. The invention as in claim 22, wherein said deformations are on one of said fastening strips.

25. The invention as in claim 1, wherein said at least one fastening strip includes a base and said base includes a flexure point which facilitates the formation of said deformation.

26. The invention as in claim 25, wherein said flexure point includes an area of reduced cross-section which facilitates the formation of said deformation.

27. The invention as in claim 26, wherein said area is a notch.

28. The invention as in claim 27, wherein said notch is V-shaped.

29. The invention as in claim 27, wherein said notch is U-shaped.

30. The invention as in claim 26, wherein said fastening strips have mating sides and non-mating sides.

31. The invention as in claim 30, wherein said area is on said mating side.

32. The invention as in claim 30, wherein said area is on said non-mating side.

33. The invention as in claim 25 wherein said flexure point includes a coextruded portion which facilitates the formation of said deformation.

34. The invention as in claim 33 wherein said coextruded portion has a different modulus of elasticity than other portions of said base.

35. The invention as in claim 1 wherein said deformation is an inward deformation.

36. The invention as in claim 1 wherein said deformation is an outward deformation.

37. A container comprising first and second sidewalls, said first and second sidewalls including mating first and second fastening strips respectively, said first and second fastening strips comprising a closure device arranged to be interlocked over a predetermined length, at lease one of said fastening strips having a non-deformed position before occlusion of said closure device and having a deformation after occlusion of said closure device, said deformation providing tactile confirmation of occlusion of said closure device.

38. The invention as in claim 37 wherein said first fastening strip including a first closure element and further including a first wing extending from said first fastening strip;

said second fastening strip including a second closure element for mating with said first closure element, said second fastening strip further including a second wing for engaging with said first wing; whereby said first wing engages with said second wing such that at least a portion of said first fastening strip deflects when said first and second fastening strips interlock to thereby create a deformation in said first fastening strip.

39. The invention as in claim 38, wherein said first closure element comprises a pair of spaced-apart webs integrally attached to said first fastening strip and extending therefrom, said webs terminating in male hooks, said male hooks comprising male hook portions facing away from one another, and wherein said second closure element comprises a pair of spaced-apart webs integrally attached to said second fastening strip and extending therefrom, said webs terminating in female hooks, said female hooks comprising female hook portions facing towards one another to engage said male hooks.

40. The invention as in claim 39, wherein said at least one fastening strip includes a base and said base includes a flexure point which facilitates the formation of said deformation.

41. The invention as in claim 40, wherein said point is adjacent said first closure element.

42. The invention as in claim 40, wherein said point is between said first closure element and said first wing.

43. The invention as in claim 40, wherein said point is between said webs.

44. The invention as in claim 39, wherein said fastening strip includes a pair of first wings, a base and said base has two flexure points, one of said points located between said first closure element and one of said wings and the other of said points located between said first closure element and the other of said wings.

45. The invention as in claim 44, wherein said base includes a third flexure point and said third point is between said webs.

46. The invention as in claim 39, wherein one of said fastening strips includes a spacing member.

47. The invention as in claim 46, wherein said other of said fastening strips includes an engagement surface.

48. The invention as in claim 38, wherein said first closure element comprises a first web integrally attached to said first fastening strip and extending therefrom, said first web terminating in an arrowhead, said second closure element comprises a second web integrally attached to said second fastening strip and extending therefrom, said second web terminating in a mating configuration for said arrowhead.

49. The invention as in claim 48 wherein said at least one fastening strip includes a base and said base includes a flexure point which facilitates the formation of said deformation.

50. The invention as in claim 49, wherein said point is adjacent said first closure element.

51. The invention as in claim 49, wherein said point is between said first closure element and said first wing.

52. The invention as in claim 48, wherein said fastening strip includes a pair of first wings, a base and said base has two flexure points, one of said points located between said first closure element and one of said wings and the other of said points located between said first closure element and the other of said wings.

53. The invention as in claim 38, wherein said fastening strips are separated by a first distance when said first wing engages said second wing but said first closure element and second closure element are unoccluded, said fastening strips are separated by a second distance when said first closure element and said second closure element are occluded, said second distance is less than said first distance.

54. The invention as in claim 38, said first fastening strip including a pair of first wings integrally attached to said first fastening strip and extending therefrom, said first wings spaced apart on said first fastening strip, said second fastening strip including a pair of second wings integrally attached to said second fastening strip and extending therefrom, said second wings spaced apart on said second fastening strip so as to engage with said first wings.

55. The invention as in claim 38, wherein said first wings are Y-shaped.

56. The invention as in claim 38, wherein said first wings are curved.

57. The invention as in claim 38, wherein said second fastening strip includes a plurality of protrusions for dynamically engaging with said first wing.

58. The invention as in claim 38, wherein said closure device has two deformations.

59. The invention as in claim 58, wherein one of said deformations is on one of said fastening strips and the other of said deformations is on the other of said fastening strips.

60. The invention as in claim 58, wherein said deformations are on one of said fastening strips.

61. The invention as in claim 37, wherein said at least one fastening strip includes a base and said base includes a flexure point which facilitates the formation of said deformation.

62. The invention as in claim 61 wherein said flexure point includes an area of reduced cross-section which facilitates the formation of said deformation.

63. The invention as in claim 62, wherein said area is a notch.

64. The invention as in claim 63, wherein said notch is V-shaped.

65. The invention as in claim 63, wherein said notch is U-shaped.

66. The invention as in claim 62, wherein said fastening strips have mating sides and non-mating sides.

67. The invention as in claim 66, wherein said area is on said mating side.

68. The invention as in claim 66, wherein said area is on said non-mating side.

69. The invention as in claim 61 wherein said flexure point includes a coextruded portion which facilitates the formation of said deformation.

70. The invention as in claim 69 wherein said coextruded portion has a different modulus of elasticity than other portions of said base.

71. The invention as in claim 37 wherein said deformation is an inward deformation.

72. The invention as in claim 37 wherein said deformation is an outward deformation.

73. A method for using a closure device comprising the step as of:

providing a first interlocking fastening strip, providing a second interlocking fastening strip having a non-deformed position, occluding said first fastening strip and said second fastening strip over a predetermined length, creating a deformation in at least one of said fastening strips after occlusion of said closure device, providing tactile contact with said deformation to confirm occlusion of said closure device.

74. The invention as in claim 73 further comprising the step of providing at least one of said fastening strips with a base and said base including a flexure point which facilitates the formation of said deformation.

75. The invention as in claim 74 further comprising the step of providing a flexure point which includes an area of reduced cross-section.

76. The invention as in claim 74 further comprising the step of providing a flexure point which includes a coextruded portion.

77. The invention as in claim 73 further comprising the step of creating a second deformation.

78. The invention as in claim 77 further comprising the step of creating said first deformation on one of said fastening strips and the second deformation on the other of said fastening strips.

79. The invention as in claim 77 further comprising the step of creating said first deformation and said second deformation on one of said fastening strips.

* * * * *